US010315868B2

(12) United States Patent
Nakagawa

(10) Patent No.: US 10,315,868 B2
(45) Date of Patent: Jun. 11, 2019

(54) SHEET FEEDING APPARATUS AND IMAGE FORMING APPARATUS

(71) Applicant: CANON KABUSHIKI KAISHA, Tokyo (JP)

(72) Inventor: Tomohito Nakagawa, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/044,313

(22) Filed: Feb. 16, 2016

(65) Prior Publication Data

US 2016/0257507 A1 Sep. 8, 2016

(30) Foreign Application Priority Data

Mar. 5, 2015 (JP) ..... 2015-043472
Dec. 11, 2015 (JP) ..... 2015-241946

(51) Int. Cl.
*B65H 1/26* (2006.01)
*B65H 1/28* (2006.01)
*B65H 1/08* (2006.01)

(52) U.S. Cl.
CPC ..... *B65H 1/26* (2013.01); *B65H 1/08* (2013.01); *B65H 1/266* (2013.01); *B65H 1/28* (2013.01); *B65H 2402/54* (2013.01); *B65H 2403/20* (2013.01); *B65H 2403/73* (2013.01); *B65H 2405/3311* (2013.01); *B65H 2801/06* (2013.01)

(58) Field of Classification Search
CPC . B65H 1/26; B65H 1/263; B65H 1/30; B65H 1/28; B65H 2405/33; B65H 3/44; B65H 2405/324; B65H 2405/31
USPC ..... 271/157, 158, 159, 9.07, 9.08
See application file for complete search history.

(56) References Cited

U.S. PATENT DOCUMENTS 5,351,112 A 9/1994 Naito et al.
5,455,667 A 10/1995 Hiroi et al.
5,472,183 A * 12/1995 Kubo ..... B65H 1/08 271/110

(Continued)

FOREIGN PATENT DOCUMENTS

EP 2487126 A2 8/2012
JP 3-138227 * 6/1991

(Continued)

OTHER PUBLICATIONS

European Search Report issued in corresponding European Application No. 16155884.6 dated Jul. 28, 2016.

*Primary Examiner* — Thomas A Morrison
(74) *Attorney, Agent, or Firm* — Venable LLP

(57) ABSTRACT

A sheet feeding apparatus includes an apparatus body, a feed member feeding a sheet, and a sheet storage member having first and second sheet storage portions. A sheet shifting portion pushes an upstream end of the sheet in the second sheet storage portion in a first direction so as to shift the sheet in the second sheet storage portion to the first sheet storage portion in the first direction. A driving motor generates a driving force moving the sheet shifting portion, and a moving portion moves the sheet shifting portion from a first position to a second position farther from the first sheet storage portion in a state in which the sheet shifting portion does not receive the driving force from the driving motor.

29 Claims, 11 Drawing Sheets

(56) References Cited

U.S. PATENT DOCUMENTS

| | | | | |
|---|---|---|---|---|
| 5,501,444 | A * | 3/1996 | Yukimachi | B65H 1/14 271/10.11 |
| 5,552,859 | A | 9/1996 | Nakagawa et al. | |
| 5,579,083 | A | 11/1996 | Naito et al. | |
| 5,819,151 | A | 10/1998 | Naito et al. | |
| 6,021,305 | A | 2/2000 | Sato et al. | |
| 6,038,424 | A | 3/2000 | Nakagawa | |
| 6,098,977 | A | 8/2000 | Sato et al. | |
| 6,131,898 | A | 10/2000 | Hiroi et al. | |
| 2012/0074640 | A1 | 3/2012 | Chae et al. | |
| 2015/0284195 | A1 | 10/2015 | Kushida et al. | |
| 2015/0353303 | A1 | 12/2015 | Nakagawa et al. | |

FOREIGN PATENT DOCUMENTS

| | | | |
|---|---|---|---|
| JP | 09077274 | A | 3/1997 |
| JP | 3411135 | B2 | 5/2003 |

* cited by examiner

SHEET FEEDING APPARATUS AND IMAGE FORMING APPARATUS

BACKGROUND OF THE INVENTION

Field of the Invention

The present invention relates to a sheet feeding apparatus applicable to an image forming apparatus such as a printer and to an image forming apparatus including the same.

Description of the Related Art

Hitherto, there is known a sheet feeding apparatus comprising a first storage portion in which a sheet is stacked, a feed roller feeding the sheet from the first storage portion, a second storage portion arrayed horizontally with the first storage portion, and a sheet bundle shifting plate shifting sheets within the second storage portion collectively to the first storage portion as disclosed in Japanese Patent No. 3411135 for example. The sheet feeding apparatus also includes a shift home sensor. A state of the shift home sensor is determined when a sheet feed cassette is set after turning the power ON. The shift home sensor is turned ON when a back fence (sheet shift portion) is located at a home position and is turned OFF when the back fence is not located at the home position. Then, in a case when the sheet feed cassette is drawn out of an apparatus body while shifting the sheets during which the sensor is turned OFF, the back fence is moved when the sheet feed cassette is set again to continue the operation of shifting the sheet bundle from the second storage portion to the first storage portion.

However, in a case when the sheet feed cassette is erroneously drawn out of the apparatus body while shifting the sheets, there is a possibility of causing the following problem in resetting the sheet feed cassette by noticing that the sheet is left in the first storage portion in the sheet feeding apparatus described above. That is, it is conceivable to erroneously end up setting a sheet bundle to a back side of the back fence (on the second storage portion side of the back fence) stopping on the first storage portion side in setting the sheet bundle to the sheet feed cassette drawn out of the apparatus body. In this case, the back fence cannot return to its home position on the second storage portion side because the sheet bundle stacked on the back of the back fence obstructs. Thereby, such problems that the apparatus body stops to operate and an alarm is indicated occur, and recovery is not made until when an user removes the sheet bundle erroneously stacked as described above, thus inviting a cumbersome resetting work.

SUMMARY OF THE INVENTION

According to an embodiment of the invention, a sheet feeding apparatus comprises an apparatus body, a feed member feeding a sheet, a sheet storage member configured to be movable to an attachment position where the sheet storage member is attached to the apparatus body and to a draw-out position where the sheet storage member is drawn out of the attachment position, and comprising a first sheet storage portion in which the sheet to be fed by the feed member is stored and a second sheet storage portion being provided adjacent horizontally to the first sheet storage portion and storing a sheet, a sheet shifting portion configured to shift the sheet in the second sheet storage portion to the first sheet storage portion, the sheet shifting portion being capable of positioning at a first position and a second position farther than the first position from the first sheet storage portion, a driving unit moving the sheet shifting portion by linking with the sheet shifting portion in a state in which the sheet storage member is located at the attachment position, and a moving portion configured to move the sheet shifting portion from the first position to the second position in a state in which the link of the sheet shifting portion with the driving unit is disconnected in response to a drawing operation of the sheet storage member from the apparatus body in a state in which the sheet shifting portion has moved to the first position by the driving unit.

Further features of the present invention will become apparent from the following description of exemplary embodiments with reference to the attached drawings.

DESCRIPTION OF THE EMBODIMENTS

Figure 1:
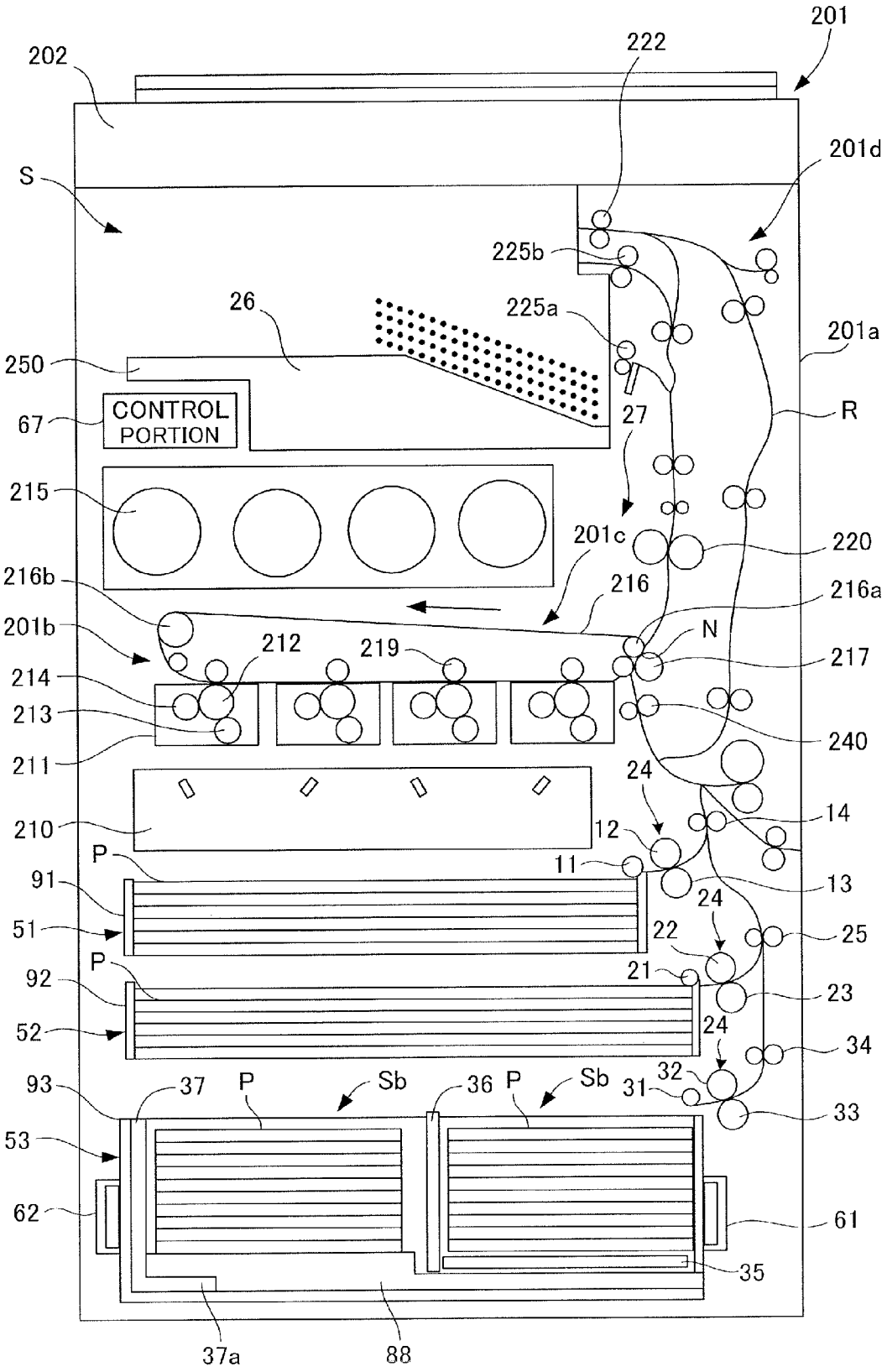
FIG. 1 is a section view schematically illustrating a configuration of a laser beam printer, i.e., an image forming apparatus, including a sheet feeding apparatus of an embodiment.

An embodiment of the present invention will be described in detail below with reference to the drawings. At first, an image forming apparatus comprising a sheet feeding apparatus of the embodiment of the present invention will be described with reference to FIG. 1. FIG. 1 is a section view schematically illustrating a laser beam printer, i.e., the image forming apparatus of the embodiments, seen from a front side of the apparatus.

Image Forming Apparatus

As illustrated in FIG. 1, the full-color laser beam printer (referred to simply as a 'printer' hereinafter) 201, i.e., an image forming apparatus, includes an image forming apparatus body (referred to simply as an 'apparatus body' hereinafter) 201*a*. The apparatus body 201*a* includes a control portion 67 controlling each part of the apparatus, an image forming portion 201*b*, a fixing portion 220, and an image reading apparatus 202 disposed substantially horizontally above the apparatus body 201*a*.

The apparatus body 201*a* is provided with a discharge space S for discharging a sheet below the image reading apparatus 202. Toner cartridges 215 are disposed under the discharge space S, and a plurality (three in the present embodiment) of sheet feeding apparatuses 51, 52, and 53 is disposed at a lower part of the apparatus body 201*a*. The apparatus body 201*a* is provided with attachment spaces, not illustrated, into/out of which sheet feed cassettes 91 and 92 described later in sheet feeding apparatuses 51 and 52 can be attached/drawn. The apparatus body 201*a* is also provided with an attachment space 15 (see FIG. 6) into/out of which a sheet feed cassette 93 described later in the sheet feeding apparatus 53 can be attached/drawn. The attachment space 15 makes it possible for the sheet feeding apparatus 53 to attach/draw the sheet feed cassette 93 into/out of the apparatus body 201*a*. The sheet feed cassette 93 is configured to be able to take an attachment position in which the sheet feed cassette 93 is attached to the apparatus body 201*a* and a draw-out position in which the sheet feed cassette 93 is drawn out of the apparatus body 201*a*.

The image forming portion 201*b* is what adopts a four drum full-color system and includes a laser scanner 210 and four process cartridges 211 of forming four color toner images of yellow (Y), magenta (M), cyan (C), and black (K).

Here, each process cartridge 211 includes a photosensitive drum 212, i.e., a photosensitive body, a charger 213, a developer 214, and a cleaner not illustrated. The image forming portion 201*b* also includes an intermediate transfer unit 201*c* above the process cartridge 211.

The intermediate transfer unit 201*c* includes an intermediate transfer belt 216 wrapped around a driving roller 216*a* and a tension roller 216*b*. The intermediate transfer unit 201*c* also includes primary transfer rollers 219 disposed inside of the intermediate transfer belt 216 and being in contact with an inner surface of the intermediate transfer belt 216 at positions facing the photosensitive drums 212. The intermediate transfer belt 216 is composed of a film-like member, is in contact with the respective photosensitive drums 212 and is rotated in a direction of an arrow in FIG. 1 by the driving roller 216*a* driven by a driving portion not illustrated.

The respective color toner images having negative polarity on the photosensitive drums 212 are sequentially superimposed and transferred onto the intermediate transfer belt 216 by positive transfer bias applied from the primary transfer rollers 219 to the intermediate transfer belt 216. Thereby, a color image is formed on the intermediate transfer belt 216. Disposed at a position facing the driving roller 216*a* is a secondary transfer roller 217 transferring the color image formed on the intermediate transfer belt 216 onto a sheet P. It is noted that a secondary transfer portion is constructed by a secondary transfer nip portion N formed by the driving roller 216*a* and the secondary transfer roller 217 being in pressure contact with the driving roller 216*a*.

A fixing portion 220 is disposed downstream in a sheet conveyance direction of the secondary transfer roller 217, and a first discharge roller pair 225*a*, a second discharge roller pair 225*b*, and a double-side inverting portion 201*d* are disposed above the fixing portion 220. The double-side inverting portion 201*d* includes an inverse roller pair 222 configured to rotate normally and reversely, a re-conveyance passage R conveying a sheet of which an image has been formed on a first surface thereof again to the image forming portion 201*b*, and others. It is noted that an image forming unit 27 forming the image on the sheet P delivered from the sheet feeding apparatuses 51, 52, and 53 is constructed by the image forming portion 201*b*, the secondary transfer nip portion N, and the fixing portion 220.

The image forming apparatus constructed as described above operates as follows. Image information read by the image reading apparatus 202 or inputted from an outside device such as a personal computer (PC) not illustrated is converted into electrical signals after undergoing image processing and is transmitted to a laser scanner 210 of the image forming portion 201*b*.

Then, in the image forming portion 201*b*, surfaces of the photosensitive drums 212 of the respective process cartridges 211 are scanned by laser beams corresponding to image information of yellow, magenta, cyan, and black component colors emitted from the laser scanner 210. Thereby, the surfaces of the photosensitive drums 212 charged homogeneously with a predetermined polarity and potential by the charger 213 are sequentially exposed, and electrostatic latent images of yellow, magenta, cyan, and black are sequentially formed on the photosensitive drums 212 of the respective process cartridges 211.

Then, the electrostatic latent images are developed and visualized by toners of the respective colors of yellow, magenta, cyan, and black, and the respective color toner images on the respective photosensitive drums 212 are sequentially superimposed and transferred onto the intermediate transfer belt 216 by the primary transfer bias applied to the primary transfer rollers 219. Thereby, a color toner image is formed on the intermediate transfer belt 216.

Meanwhile, the sheet P delivered from either one of the sheet feeding apparatuses 51, 52, and 53 passes through a registration roller pair 240 and is sent to the secondary transfer nip portion N. Here, the registration roller pair 240 corrects a skew of the sheet P by making a front end of the sheet P follow a nip portion of the registration roller pair 240 such that the sheet P abutting against the nip portion forms a loop. The toner images formed in the image forming portion 201*b* are secondarily and collectively transferred onto the sheet P at the secondary transfer nip portion N.

In succession, the sheet P onto which the toner images have been secondarily transferred as described above is conveyed to the fixing portion 220 to be heated and pressed to fix the toner images on the sheet P as a color image. After that, the sheet P on which the color image has been fixed is discharged to the discharge space S by the first discharge roller pair 225*a* and is stacked on a stacking portion 26 provided within the discharge space S.

The sheet feeding apparatuses 51 and 52 are provided respectively with sheet feed cassettes 91 and 92 storing the sheet P. The sheet feeding apparatus 51 is also provided with a sheet feed portion 24 delivering the sheet P stored in the sheet feed cassette 91 toward a sheet drawing roller pair 14. The sheet feeding apparatus 52 is provided with the sheet feed portion 24 delivering the sheet P stored in the sheet feed cassette 92 toward a drawing roller pair 25.

The sheet feed portion 24 corresponding to the sheet feed cassette 91 includes a pickup roller 11, a feed roller 12, and a retard roller 13 disposed above and downstream in a sheet feed direction of the sheet feed cassette 91. The sheet feed portion 24 corresponding to the sheet feed cassette 92 includes a pickup roller 21, a feed roller 22, and a retard roller 23 disposed above and downstream in the sheet feed direction of the sheet feed cassette 92.

The sheet feeding apparatus 53 is provided with a sheet feed cassette 93 storing the sheet P and a sheet feed portion 24 delivering the sheet P stored in a sheet feed cassette 93 toward a pull-out roller pair 34 located downstream of the sheet feed portion 24. The sheet feed portion 24 corresponding to the sheet feed cassette 93 includes a pickup roller 31, a feed roller 32, and a retard roller 33 disposed above and downstream in the sheet feed direction of the sheet feed cassette 93.

The pickup rollers 11 and 21 are turnably supported by arms not illustrated respectively turnable centering on the feed rollers 12 and 22 and deliver the sheet P by rotating while being in pressure contact with the sheet P stored respectively in the sheet feed cassettes 91 and 92. The sheet feed cassettes 91 and 92 are supported such that they can be attached to/drawn out of the apparatus body 201*a* in a front-back direction of FIG. 1.

The pickup roller 31 is turnably supported by an arm not illustrated turnable centering on the feed roller 32 and delivers the sheet P stored in the sheet feed cassette 93 by rotating while being in pressure contact with the sheet P stored in the sheet feed cassette 93. It is noted that the sheet feed cassette 93 is supported such that the sheet feed cassette 93 can be attached to/drawn out of the apparatus body 201*a* along drawing rails 61 and 62 in the front-back direction of FIG. 1.

Then, in response to a start of an image forming operation, the sheet P is separated and fed one by one from either one of the sheet feed cassettes 91, 92, and 93 by the sheet feed portion 24. The sheet P sent out by either one of the pickup rollers 11, 21, and 31 is conveyed by either corresponding one of the feed rollers 12, 22, and 32. If the sheets are doubly fed at this time, the sheet P of the second one and thereafter are returned to a side of the sheet feed cassettes 91, 92, and 93 by either corresponding one of the retard rollers 13, 23, and 33. The sheet P separated and conveyed by either corresponding one of the feed rollers 12, 22, and 32 and the retard rollers 13, 23, and 33 is sent downstream farther by either one of the pull-out roller pairs 14, 25, and 34 and is conveyed to the registration roller pair 240.

Sheet Feeding Apparatus

Next, the sheet feeding apparatus 53 of the present embodiment will be described in detail below with reference to FIGS. 2A through 3C. It is noted that FIGS. 2A through 3C are section views describing the sheet feeding apparatus 53 of the present embodiment in different states.

As illustrated in FIGS. 2A through 3C, the sheet feeding apparatus 53 is configured such that the sheet P can be fed one by one in a state in which a bundle of sheets of small size such as A4 size and letter size is stacked respectively in first and second sheet storage portions 28*b* and 28*a*. The sheet feeding apparatus 53 is configured to feed in order from the sheet P within the first sheet storage portion 28*b* on a right side in the drawings. The sheet feeding apparatus 53 adopts a tandem cassette feeding structure in which a bundle of sheets P within the second sheet storage portion 28*a* on a left side of the drawings is collectively shifted to the first sheet storage portion 28*b* when the sheet within the first sheet storage portion 28*b* runs out.

The sheet feeding apparatus 53 is provided with a lifter plate 35 supported so as to lift the stacked sheet P within the first sheet storage portion 28*b*. The pickup roller 31, disposed above the lifter plate 35, of the apparatus body 201*a* (see FIG. 1) is supported turnably by the arm not illustrated turnable centering on the feed roller 32 and feeds the sheet P stacked on the lifter plate 35. Then, the sheet P thus fed is conveyed by the feed roller 32. However, in a case when two or more sheets are fed, the second sheet and thereafter are returned to a side of the sheet feed cassette 93 by a separation action effected by the feed roller 32 and the retard roller 33. It is noted that the pickup roller 31 composes a feed member feeding the sheet P.

Figure 2A:
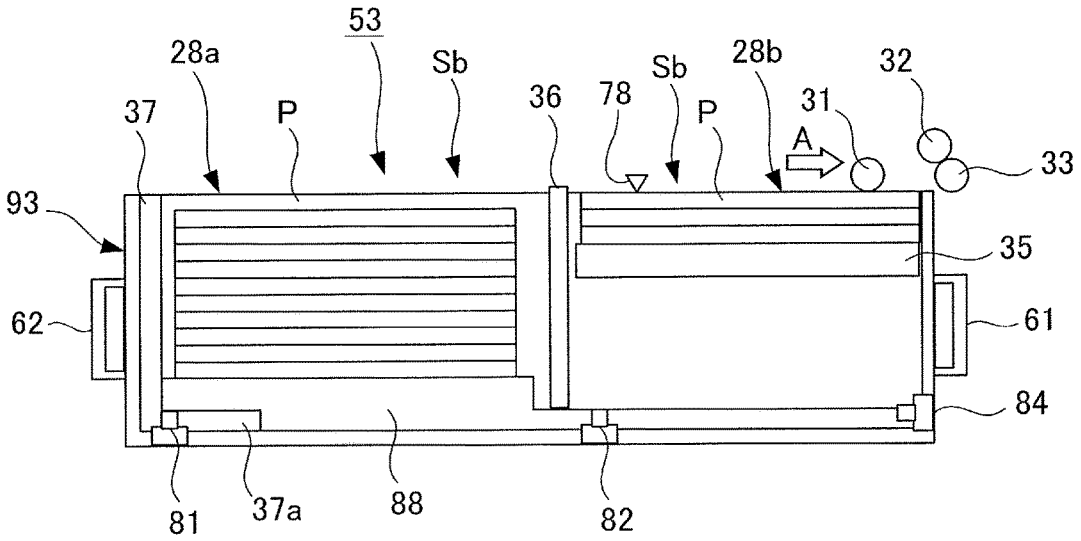
FIG. 2A is a section view schematically illustrating a feeding state of the sheet feeding apparatus of the present embodiment.
Figure 2B:
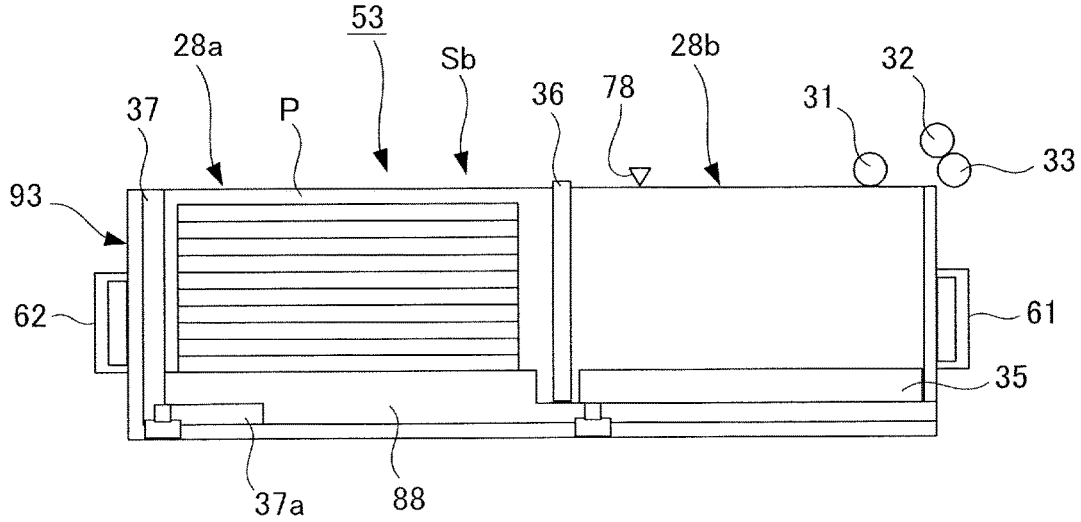
FIG. 2B is a section view schematically illustrating a feed finished state of the sheet feeding apparatus of the present embodiment.

As illustrated in FIGS. 2A and 2B, a lifter HP (home position) sensor 84 is disposed at a lower part of a front end portion of the sheet feed cassette 93, i.e., a sheet storage member. The control portion 67 (see FIG. 1) controls and drives a lifter motor 86 (see FIG. 11) such that the lifter plate 35 is lifted corresponding to a level in a vertical direction of the pickup roller 31 so that the pickup roller 31 can be always stably in contact with an uppermost sheet of the sheets P on the lifter plate 35.

The sheet feed cassette 93 includes the first sheet storage portion 28*b* on the right side of the drawings and the second sheet storage portion 28*a* on the left side of the drawings, and is supported so as to be attachable to/drawable out of an attachment space 15 (see FIG. 6) within the apparatus body 201*a*. The first sheet storage portion 28*b* stores the sheet P to be fed by the pickup roller 31. The second sheet storage portion 28*a* adjoins the first sheet storage portion 28*b* in a horizontal direction and stores sheets P to be replenished to the first sheet storage portion 28*b*.

The sheet feeding apparatus 53 also comprises a fixed set tray 88 formed such a part thereof extends from a bottom of the second sheet storage portion 28*a* to a side of the first sheet storage portion 28*b*. The sheet bundle moving member 37 supported so as to slidably move from the second sheet storage portion 28*a* to the first sheet storage portion 28*b* side along the set tray 88 is disposed in the sheet feed cassette 93. The sheet bundle moving member 37 is provided so as to be able to be in contact with the sheet bundle Sb set in the second sheet storage portion 28*a*. That is, the sheet bundle moving member 37 is supported so as to be able to slidably move in the horizontal direction in FIGS. 2A and 2B by the driving motor 50 controlled by the control portion 67 and slidably moves the whole sheet bundle Sb set in the second sheet storage portion 28*a* to the first sheet storage portion 28*b*. It is noted that the sheet bundle moving member 37 composes a sheet shift portion movable so as to shift the sheet bundle Sb collectively from the second sheet storage portion 28*a* to the first sheet storage portion 28*b*.

As illustrated in FIGS. 2A through 3C, the sheet feed cassette 93 of the sheet feeding apparatus 53 is provided with an arm member 36 partitioning the left sheet bundle Sb from the right sheet bundle Sb in setting the sheet bundle Sb at a center part thereof.

Figure 11:
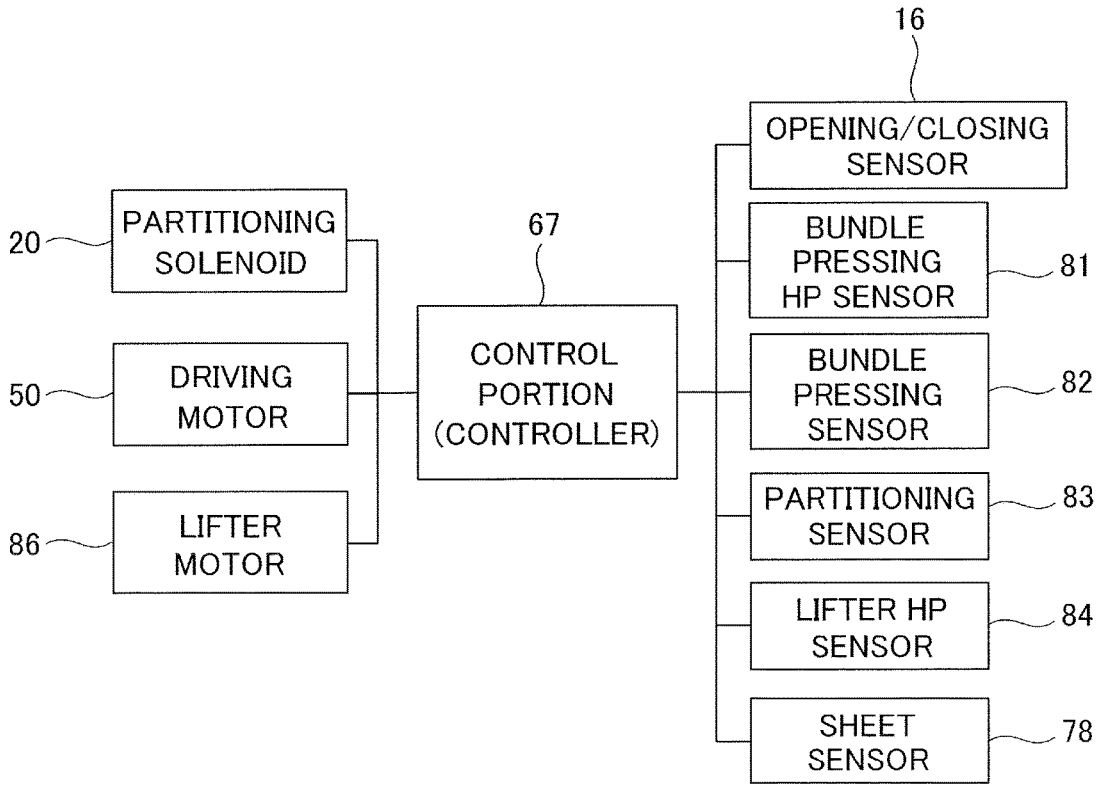
FIG. 11 is a block diagram illustrating a control system of the image forming apparatus of the present embodiment.

The arm member 36 is constructed so as to be able to move between a partitioning position and an opening position by being driven by a partitioning solenoid 20 (see FIG. 11). The partitioning position is a position partitioning the first sheet storage portion 28*b* from the second sheet storage portion 28*a* by projecting between the first and second sheet storage portions 28*b* and 28*a*, and the opening position is a position for opening between the first and second sheet storage portions 28*b* and 28*a* by receding from the partitioning position.

A home position of the arm member 36 is normally the partitioning position where the arm member 36 projects as a partition between the sheet bundles Sb of the first and second sheet storage portions 28*b* and 28*a*. Then, the arm member 36 recedes from the partitioning position to the opening position in shifting the sheet bundle Sb stacked in the second sheet storage portion 28*a* on the left side to the first sheet storage portion 28*b* on the right side in FIGS. 2A and 2B.

Still further, as illustrated in FIGS. 2A and 2B, the apparatus body 201*a* is provided with a sheet sensor 78 (see FIG. 11) disposed above the lifter plate 35 of the first sheet storage portion 28*b*. The control portion 67 (see FIGS. 1 and 11) of the apparatus body 201*a* controls the partitioning solenoid 20 so as to move the arm member 36 to the opening position before operating and shifting the sheet bundle moving member 37 based on a sheet detection result of the sheet sensor 78. This arrangement makes it possible to operate and shift the sheet bundle moving member 37 after moving the arm member 36 quickly to the opening position and to smoothly replenish the sheet bundle Sb to the first sheet storage portion 28*b* when the sheet P within the first sheet storage portion 28*b* runs out.

Figure 4A:
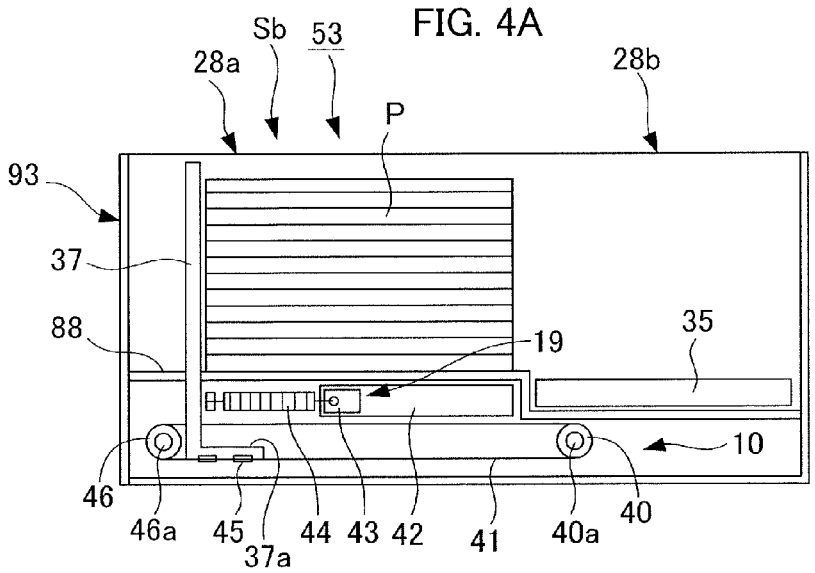
FIG. 4A is a section view schematically illustrating a state corresponding to the state in FIG. 2B of a forced moving mechanism of the sheet feeding apparatus of the present embodiment.
Figure 4B:
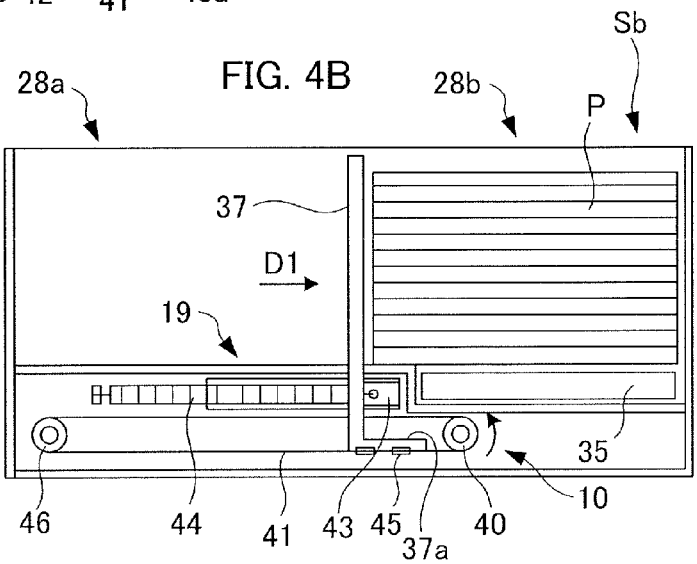
FIG. 4B is a section view schematically illustrating a state corresponding to the state in FIG. 3B of the forced moving mechanism of the sheet feeding apparatus of the present embodiment.
Figure 4C:
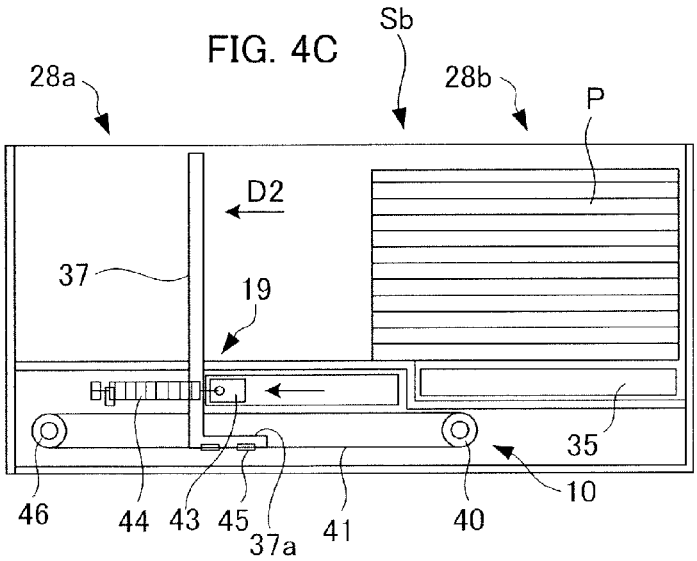
FIG. 4C is a section view schematically illustrating a state in which a sheet bundle moving member is forcibly moved to a second sheet storage portion by the forced moving mechanism of the sheet feeding apparatus of the present embodiment.
Figure 9:
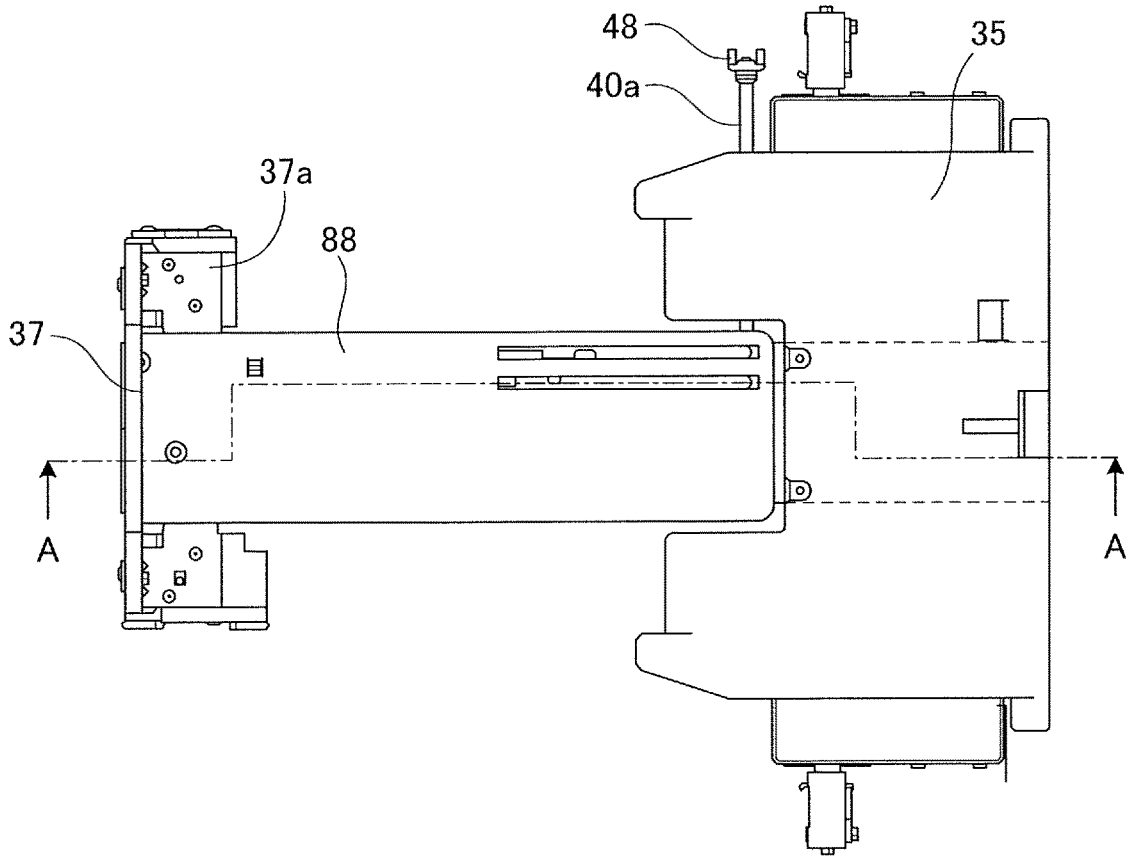
FIG. 9 is a plan view specifically illustrating the sheet feeding apparatus of the present embodiment.
Figure 10:
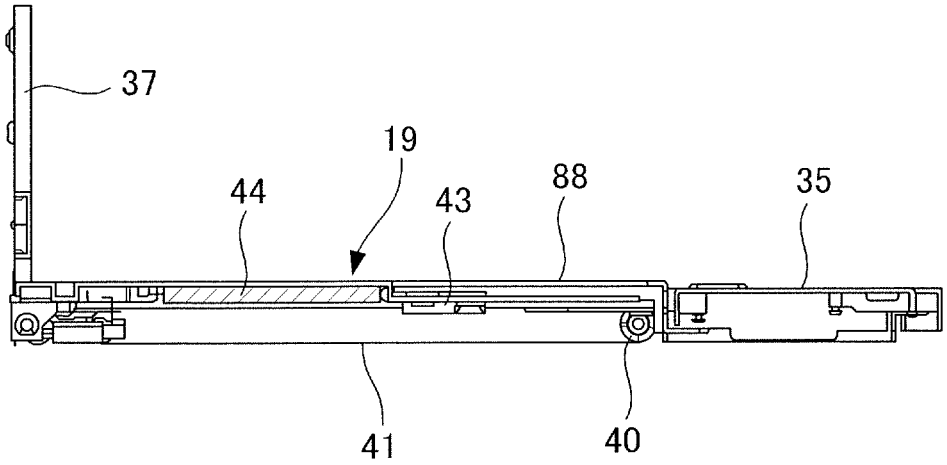
FIG. 10 is a section view schematically illustrating the sheet feeding apparatus taken along a line A-A in FIG. 9.

Next, the sheet feeding apparatus 53 of the present embodiment will be described in detail with reference to FIGS. 4A through 4C, 9, and 10. It is noted that FIG. 4A is a section view illustrating a state of the sheet feeding apparatus 53 of the present embodiment in which the sheet bundle Sb is stacked in the second sheet storage portion 28*a*. FIG. 4B is a section view illustrating a state of the sheet feeding apparatus 53 of the present embodiment in which the sheet bundle Sb is shifted collectively from the second sheet storage portion 28*a* to the first sheet storage portion 28*b*. FIG. 4C is a section view illustrating a state in which the sheet bundle moving member 37 which has completed to shift the sheet bundle Sb is returned to the second sheet storage portion 28*a*. It is noted that FIG. 4C is also a section view illustrating an operation of returning the sheet bundle moving member 37 to the second sheet storage portion 28*a* when the sheet feed cassette 93 is drawn out of the apparatus body 201*a*. FIG. 9 is a plan view specifically illustrating the sheet feeding apparatus 53 in FIGS. 5A and 5B. FIG. 10 is a section view taken along a line A-A in FIG. 9.

Figure 3A:
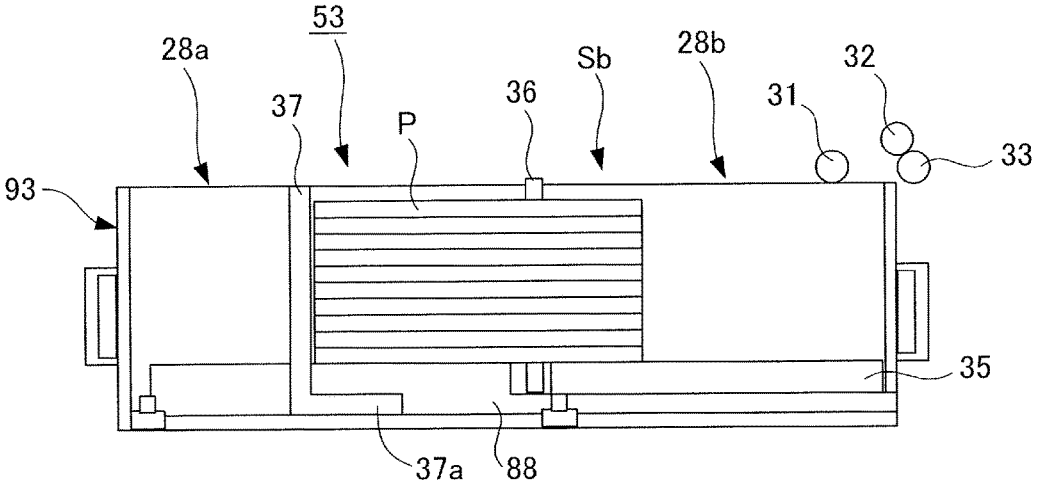
FIG. 3A is a section view schematically illustrating a sheet bundle shifting state of the sheet feeding apparatus of the present embodiment.
Figure 3B:
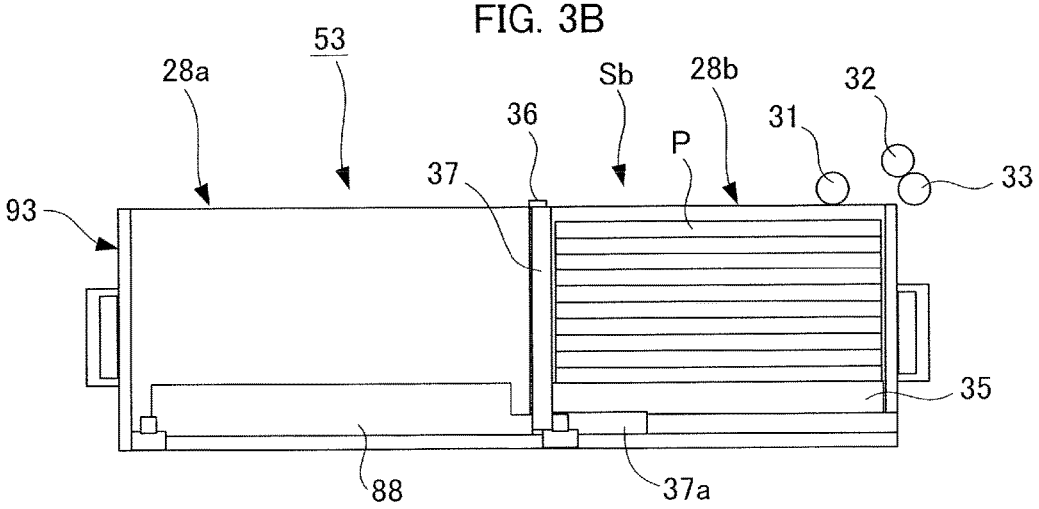
FIG. 3B is a section view schematically illustrating a sheet bundle shifting completion state of the sheet feeding apparatus of the present embodiment.
Figure 3C:
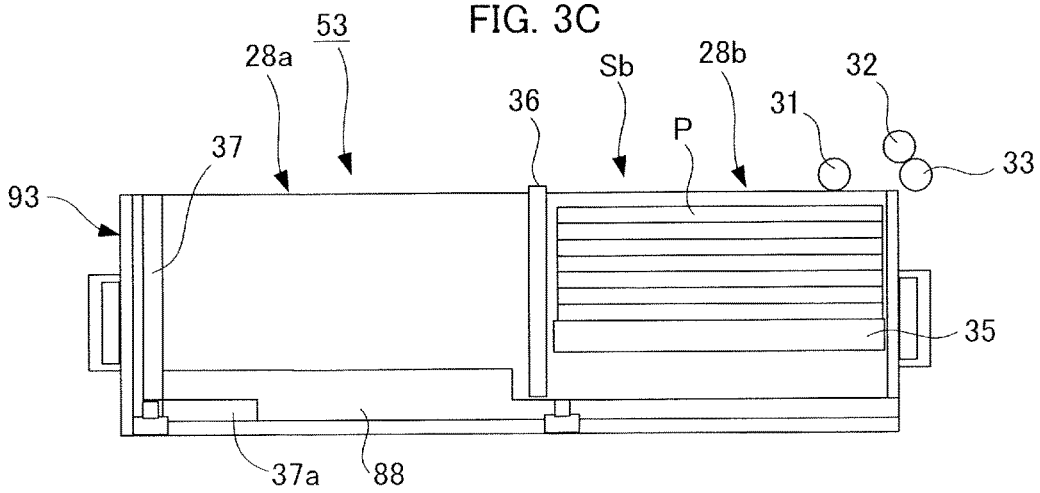
FIG. 3C is a section view schematically illustrating a feed restarting state of the sheet feeding apparatus of the present embodiment.

FIG. 4A corresponds to FIG. 2B, FIG. 4B corresponds to FIG. 3B, and FIG. 4C corresponds to a state in which the sheet bundle moving member 37 is on a way of returning from the state in FIG. 3B to the position of FIG. 3C. In FIGS. 4A through 4C, the arm member 36, the pickup roller 31, the feed roller 32, the retard roller 33, the drawing rails 61 and 62, and others illustrated in FIGS. 2A through 3C are not illustrated. An inner part of the set tray 88 in FIGS. 2A through 3C is illustrated in section also in FIGS. 4A though 4C, though their sizes are different more or less.

As illustrated in FIG. 4A, the sheet bundle Sb is stacked and set on the set tray in a state in which a rear end part of the sheet bundle is in contact with the sheet bundle moving member 37 located at the home position within the second sheet storage portion 28*a*.

Then, as illustrated in FIG. 4B, the sheet bundle moving member 37 is moved in a first direction D1 which is a direction in which the sheet bundle moving member 37 is moved from the second sheet storage portion 28*a* to the first sheet storage portion 28*b* by a driving unit 10 described later. Thereby, the sheet bundle Sb is shifted collectively onto the lifter plate 35 of the first sheet storage portion 28*b*.

FIG. 4C illustrates a case when the sheet feed cassette 93 is drawn out of the apparatus body 201*a* when the sheet bundle moving member 37 is located at the position between the first and second sheet storage portions 28*b* and 28*a*, i.e., a first position, as illustrated in FIG. 4B. FIG. 4C illustrates the operation of returning the sheet bundle moving member 37 to the second sheet storage portion 28*a*. As illustrated in FIG. 4C, the sheet bundle moving member 37 moves in a second direction D2 from the state illustrated in FIG. 4B to the second sheet storage portion 28*a* side by a spring force of the charged tensile spring 44 and approaches to its home position. The position of the sheet bundle moving member 37 illustrated in FIG. 4A is the home position of the sheet bundle moving member 37. The home position is located outside of the second sheet storage portion 28*a* farther than the first sheet storage portion 28*b* in the moving direction of the sheet bundle moving member 37. When the sheet bundle moving member 37 is located at the home position, the user can stack the sheet bundles Sb in the first and second sheet storage portions 28*b* and 28*a*. Then, when the sheet P stored in the first sheet storage portion 28*b* runs out, the sheet bundle moving member 37 located at the home position shifts the sheet bundle Sb stored in the second sheet storage portion 28*a* collectively to the first sheet storage portion 28*b*. The pair of tensile springs 44 is provided widthwise (in a direction of an arrow B in FIG. 5A) orthogonal to the sheet feeding direction (in a direction of an arrow A in FIG. 5A). One ends upstream in the sheet feed direction of the pair of tensile springs 44 are attached to fixing portions 89 and 90 provided on a bottom of the sheet feed cassette 93, and other ends thereof are attached to both end portions in the width direction of the charge member 43.

According to the present embodiment, the tensile spring 44 and the charge member 43 compose the forced moving mechanism, i.e., moving portion, 19 forcibly moving the sheet bundle moving member (sheet shifting portion) 37 from the first sheet storage portion 28*b* side to the second sheet storage portion 28*a* side. Here, in describing a relationship between two positions of the sheet bundle moving member 37, a position close to the first sheet storage portion 28*b* will be expressed as 'the first sheet storage portion 28*b* side' and a position far from the first sheet storage portion 28*b* will be expressed as 'the second sheet storage portion 28*a* side'. It is noted that the pair of tensile springs 44 may be one tensile spring 44 or three or more tensile springs 44 may be used depending on their disposition.

Disposed under the sheet bundle moving member 37 are driving shafts 46*a* and 40*a* extending in the width direction orthogonal to the sheet feed direction and rotatably supported upstream and downstream in the sheet feed direction (in the direction of the arrow A in FIG. 2A). A driving pulley 40 and a driven pulley 46 are respectively supported by the driving shafts 46*a* and 40*a*. An endless timing belt 41 is wound around and stretched between the driving pulley 40 and the driven pulley 46.

A bent portion 37*a* formed at a lower part of the sheet bundle moving member 37 is fixed such that the sheet bundle moving member 37 erects by fixing members 45 on a lower side of an inner circumferential surface of the timing belt 41. The bent portion 37*a* is configured so as to project in the width direction from the set tray 88 as illustrated in FIG. 9 so that the sheet bundle moving member 37 can reciprocate in the sheet feed direction by using the lengthy set tray 88 extended in the sheet feed direction as a rail.

Next, the driving mechanism and others moving the sheet bundle moving member 37 of the present embodiment will be described with reference to FIGS. 5A, 5B, and 6. It is noted that FIG. 5A is a plan view illustrating a state of the forced moving mechanism 19 which corresponds to the state in FIG. 4A, FIG. 5B is a plan view illustrating a state of the forced moving mechanism 19 which corresponds to the state in FIG. 4B, and FIG. 6 is a plan view illustrating the state in which the sheet feed cassette 93 is drawn out of the apparatus body 201*a*.

Figure 5A:
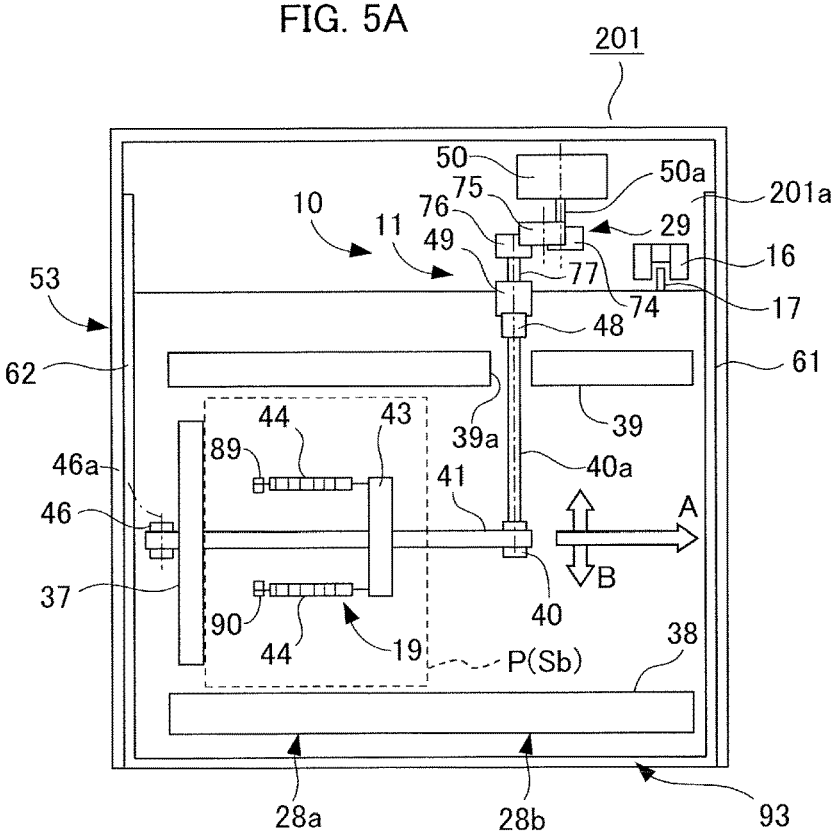
FIG. 5A is a plan view schematically illustrating a state corresponding to the state in FIG. 4A of the forced moving mechanism of the sheet feeding apparatus of the present embodiment.
Figure 5B:
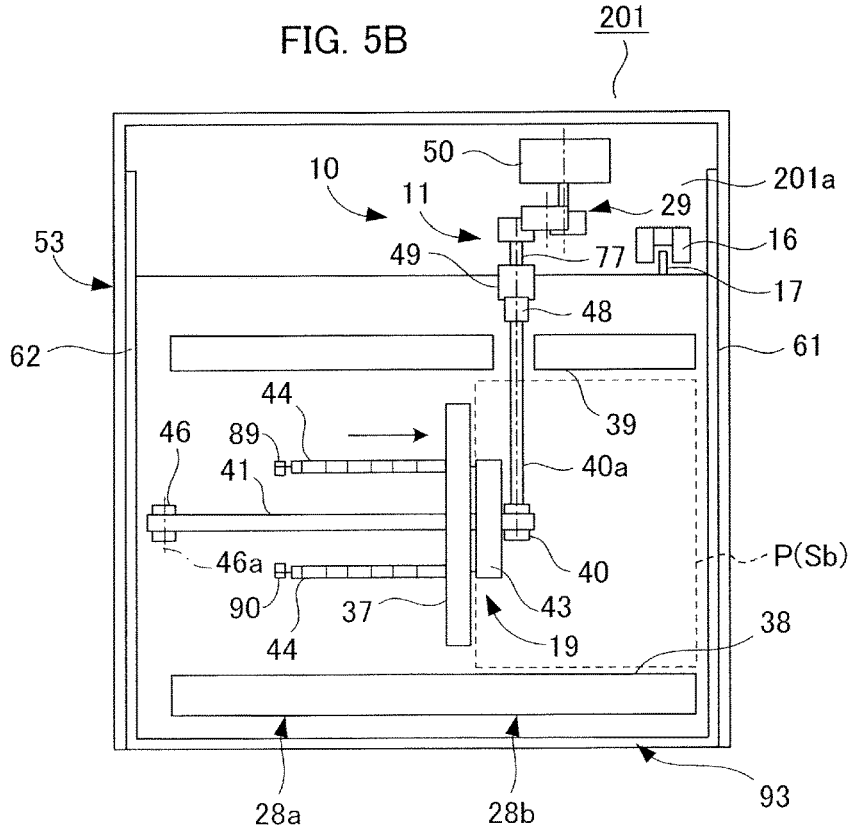
FIG. 5B is a plan view schematically illustrating a state corresponding to the state in FIG. 4B of the forced moving mechanism of the sheet feeding apparatus of the present embodiment.
Figure 6:
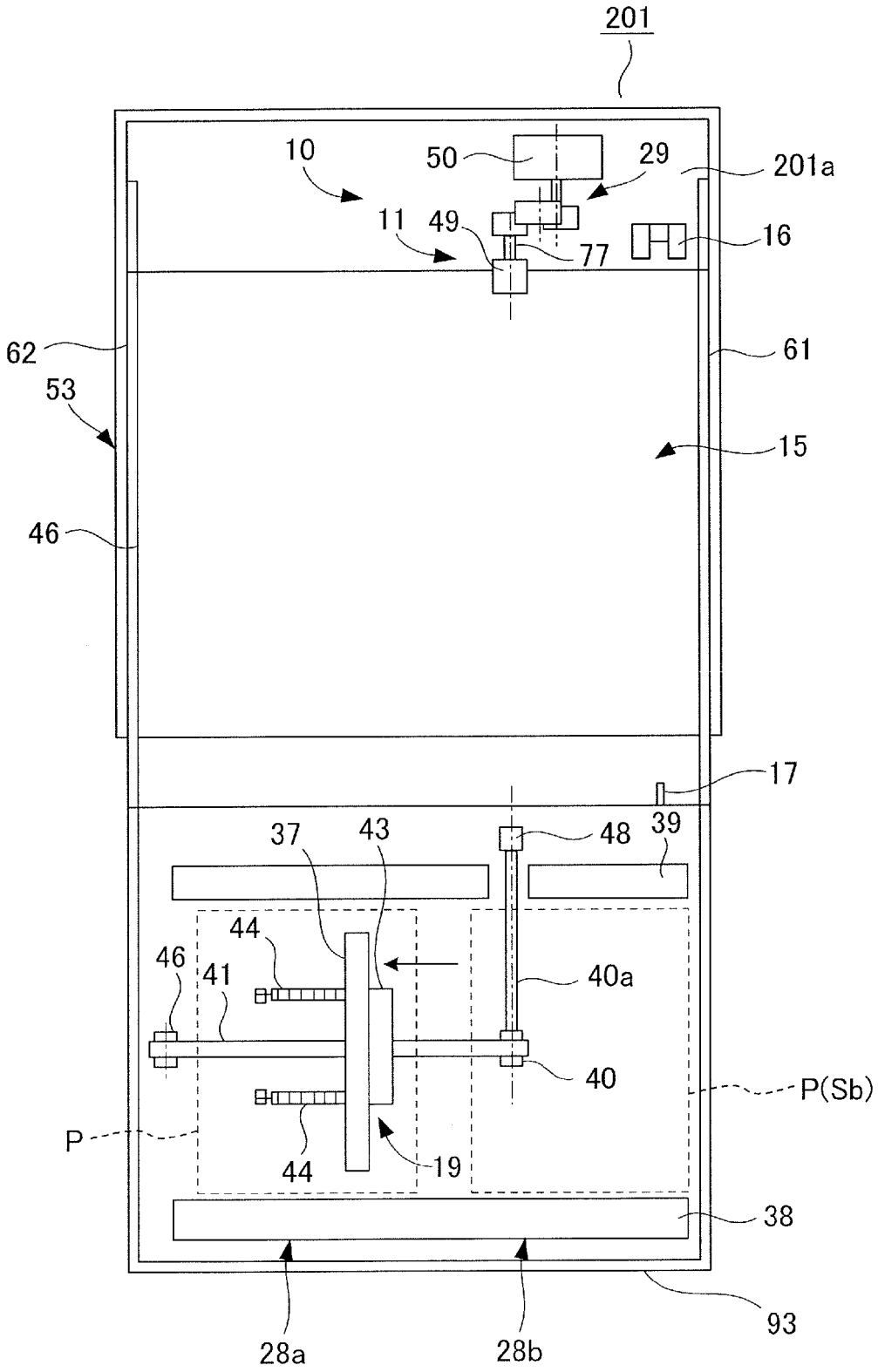
FIG. 6 is a plan view schematically illustrating a state in which a sheet feed cassette of the sheet feeding apparatus of the present embodiment is drawn out of an apparatus body.

As illustrated FIGS. 5A, 5B, and 6, the apparatus body 201*a* is provided therein with an opening/closing sensor 16 detecting whether the sheet feed cassette 93 is opened or closed, i.e., drawn out of or attached to the apparatus body 201*a*.

The sheet feed cassette 93 is provided also with side restricting plates 38 and 39 restricting and aligning the sheet P within the sheet feed cassette 93 in the width direction (in a direction of an arrow B in FIG. 5A) orthogonal to the sheet feed direction (in the direction of the arrow A in FIG. 5A). These side restricting plates 38 and 39 are supported at a bottom of the sheet feed cassette 93 so as to be able move corresponding to a widthwise size of a sheet to be set in the sheet feed cassette 93.

In response to a drive of the timing belt 41 driven by the driving pulley 40 as illustrated in FIG. 5A, the sheet bundle moving member 37 moves along with the rotation of the timing belt 41. At this time, the sheet bundle moving member 37 moves from the second sheet storage portion 28*a* side as illustrated in FIG. 5A to the first sheet storage portion 28*b*, so that the sheet bundle Sb is shifted collectively to the first sheet storage portion 28*b* and is stacked on the lifter plate 35 within the first sheet storage portion 28*b*.

The charge member 43 is supported so as to slidably move within a guide portion 42 illustrated in FIG. 4A. The guide portion 42 extends widthwise so as to be able to support the charge member 43 extending in the width direction within the set tray 88. The charge member 43 engages with the sheet bundle moving member 37 at a predetermined position, moves together with the sheet bundle moving member 37, and drags the tensile spring 44. When the shift of the sheet bundle Sb is completed as illustrated in FIG. 4B, the sheet bundle moving member 37 presses the charge member 43 together with the sheet bundle Sb to the first sheet storage portion 28*b* side. Because a spring force acts on the charge member 43 from the predetermined position in the sheet feed direction, the charge member 43 drags the tensile spring 44 and charges the spring force (moving force) by being pressed by the sheet bundle moving member 37.

As illustrated in FIGS. 5A, 5B, and 6, a driving motor 50 is fixed at a position adjacent the attachment space 15 within the apparatus body 201*a*. A pinion 74 is secured to a rotating shaft 50*a* of the driving motor 50. The apparatus body 201*a* also includes a drive transmitting coupling 49 receiving a driving force from the driving motor 50 is rotatably supported through a support mechanism not illustrated at a position facing a driven coupling 48 operative when the sheet feed cassette 93 is inserted into the attachment space 15. The driven coupling 48 engages with the drive transmitting coupling 49 when the sheet feed cassette 93 is attached to the attachment space 15 and is decoupled from the drive transmitting coupling 49 when the sheet feed cassette 93 is drawn out of the attachment space 15.

A driving gear 76 is secured to a rotating shaft 77 rotatably supporting the drive transmitting coupling 49 to the apparatus body 201*a*, and a transmission gear 75 rotatably supported by the apparatus body 201*a* is engaged with the driving gear 76. A driving shaft 40*a* supported in this state is supported in a condition in which the driving shaft 40*a* penetrates through a penetration portion 39*a* formed through the side restricting plate 39. It is noted that a driving mechanism 29 is composed of the driving motor 50, the pinion 74, the transmission gear 75, and the driving gear 76.

The rotation of the driving motor 50 is transmitted to the driven coupling 48 through the pinion 74, the transmission gear 75, the driving gear 76, the rotating shaft 77, and the drive transmitting coupling 49. Still further, because this rotation is also transmitted to the driving pulley 40 through the driving shaft 40*a*, the sheet bundle moving member 37 is moved in the direction of the arrow A illustrated in FIG. 5A while rotating the driven pulley 46 through the timing belt 41 by the rotation of the driving pulley 40.

Still further, according to the present embodiment, the driving mechanism 29 also includes the timing belt 41 rotated by the output of the driving motor 50 transmitted from the drive transmitting coupling 49 to the driven coupling 48. Then, the sheet bundle moving member 37 is linked with the timing belt 41 so as to move between the first and second sheet storage portions 28*b* and 28*a* during when the timing belt 41 rotates. This arrangement makes it possibly to steadily move the sheet bundle moving member 37 by transmitting the driving force of the driving motor 50 to the timing belt 41 through the driving shaft 40*a* and the driving pulley 40.

As illustrated in FIG. 6, the drive transmitting coupling 49 on the apparatus body 201*a* side is decoupled from the driven coupling 48 on the sheet feed cassette 93 side in the state in which the sheet feed cassette 93 is drawn out of the apparatus body 201*a*. The drive transmitting coupling 49 and the driven coupling 48 are known members transmitting driving torque of the driving motor 50. By decoupling them from each other, the transmission route of the driving motor 50 is disconnected. Then, by being released from an influence of holding torque of the driving motor 50 itself, the charge member 43 moves the sheet bundle moving member 37 quickly to the predetermined position by the charged spring force of the tensile spring 44. In the present embodiment, the charge member 43 is moved substantially around to a center position, i.e., a second position, where the sheet bundle is set in the second sheet storage portion 28*a*.

Because the sheet bundle moving member 37 returns to a position as indicated in FIG. 6, the user will not set a sheet bundle Sb because the sheet bundle moving member 37 itself is located at an obstructive position even if the user tries to set the sheet bundle Sb in the second sheet storage portion 28*a*. It becomes possible to set the sheet bundle Sb to the position of the second sheet storage portion 28*a* after moving the sheet bundle moving member 37 to the left side in FIG. 6. Because the driven coupling 48 is decoupled from the drive transmitting coupling 49 by this time, the user can readily move and position the sheet bundle moving member 37 to the left to a position (the home position illustrated in FIG. 5A) adequate for setting the sheet bundle Sb. This arrangement of moving the sheet bundle moving member 37 substantially around to the center of the second sheet storage portion 28*a* makes it possible to appeal to the user and to induce the user to reset the sheet bundle moving member 37 at the adequate position.

In the present embodiment, the home position of the sheet bundle moving member 37 is the leftmost position as indicated in FIG. 5A. In replenishing the sheet bundle Sb to the first sheet storage portion 28*b* in the state in which the sheet feed cassette 93 is attached to the apparatus body 201*a*, the sheet bundle moving member 37 which has moved to the first sheet storage portion 28*b* side and replenished the sheet bundle Sb can be returned by automatically moving to the home position by the driving force of the driving motor 50. This operation ends in several seconds, e.g., 10 seconds, though it depends on an output of the driving motor 50. Still further, basically the sheet bundle moving member 37 stands still always at the left home position.

However, if the sheet feed cassette 93 is drawn out of the apparatus body 201*a*, the transmission route of the driving force of the driving motor 50 is disconnected, so that the sheet bundle moving member 37 cannot return to the home position by the driving force of the driving motor 50. According to the present embodiment, however, the sheet bundle moving member 37 can be moved instantly in the left direction by the operation of the charge member 43 and the tensile spring 44.

Here, 'instantly' means a time, e.g., within one second, less than a time required for the user to draw the sheet feed cassette 93 out of the apparatus body 201*a*. Because the sheet bundle moving member 37 moves instantly in the left direction as described above, there is no space for setting the sheet bundle Sb on the left set tray 88, and the user will not erroneously set the sheet bundle Sb at this position. Because this arrangement makes is possible to avoid the user from erroneously setting the sheet bundle Sb, it is possible to avoid a stoppage of the printer 201 or the occurrence of a cumbersome resetting work.

Control System

Next, a control system involved in the shift of the sheet bundle of the present embodiment will be described with reference to FIG. 11. FIG. 11 is a block diagram illustrating the control system involved in the shift of the sheet bundle.

As illustrated in FIG. 11, the control system of the present embodiment comprises a control portion (controller) 67 comprising a CPU, a RAM, and a ROM. An opening/closing sensor 16, a bundle pressing HP sensor 81, a bundle pressing sensor 82, a partitioning sensor 83, a lifter HP sensor 84, and a sheet sensor 78 are connected to an input port of the control portion 67. The partitioning solenoid 20, the driving motor 50, and a lifter motor 86 are connected to an output port of the control portion 67.

The opening/closing sensor 16 is composed of a photo interrupter and detects a state of the sheet feed cassette 93 attached to the apparatus body 201*a* in response to a light blocking plate 17 (see FIGS. 5A through 6) fixed on a back surface side of the sheet feed cassette 93 and entering and receding between light emitting and receiving portions not illustrated. That is, when the light blocking plate 17 on the back surface side of the sheet feed cassette 93 moves and advances/recedes with respect to the opening/closing sensor 16, an output signal of the light receiving portion turns to Low level when the light blocking plate 17 interrupts an optical path between the light emitting and receiving portions of the photo interrupter and turns to High level when the light blocking plate 17 does not interrupt the optical path. Accordingly, it is possible to detect the state of the sheet feed cassette 93 whether or not the sheet feed cassette 93 is attached by setting a position where the output signal of the light receiving portion changes as a reference position and by detecting whether or not the sheet feed cassette 93 is located at the reference position.

The bundle pressing HP sensor 81 (see FIG. 2A) detects that the sheet bundle moving member 37 is located at the home position. The bundle pressing sensor 82 (see FIG. 2A) detects a position where the sheet bundle moving member 37 completes to press the bundle.

The partitioning sensor 83 has substantially the same structure with the opening/closing sensor 16 described above. The partitioning sensor 83 detects whether the arm member 36 is located at the partitioning position or the opening position based on the relationship of the advancing/receding move of the a light blocking plate fixed on the arm member 36 side with a photo interrupter fixed on the sheet feed cassette 93 side.

The lifter HP sensor 84 (see FIG. 2A) is disposed at a lower part of the front end of the sheet feed cassette 93 and detects a lowermost position of the lifter plate 35. The sheet sensor 78 (see FIGS. 2A and 2*b*) is disposed above the lifter plate 35 of the first sheet storage portion 28*b* and detects whether or not the sheet P exists within the first sheet storage portion 28*b*.

The driving motor 50 rotationally drives to move the sheet bundle moving member 37 from the second sheet storage portion 28*a* side to the first sheet storage portion 28*b* side and to return the sheet bundle moving member 37 from the first sheet storage portion 28*b* side to the second sheet storage portion 28*a* side in accordance to the controls made by the control portion 67.

The partitioning solenoid 20 advances/sets back a plunger not illustrated so as to turn the arm member 36 to the partitioning position/opening position in accordance to the controls made by the control portion 67. The driving motor 50 rotates in accordance to the controls of the control portion 67, and the rotation thereof is transmitted to the drive transmitting coupling 49 through the gear train including the pinion 74. The lifter motor 86 operates so as to lift the lifter plate 35 such that the uppermost sheet P on the lifter plate 35 is always and stably in contact with the pickup roller 31 corresponding to a level of the pickup roller 31 in accordance to the controls of the control portion 67.

Corresponding to the detection signals from the various sensors described above, the control portion 67 controls and drives the partitioning solenoid 20, the driving motor 50, and the lifter motor 86. The control portion 67 also controls a display on of an user's operating screen not illustrated.

Here, a series of states in which the sheet bundle Sb within the second sheet storage portion 28*a* is shifted to the first sheet storage portion 28*b* when the sheet P within the first sheet storage portion 28*b* runs out will be described with reference to FIGS. 2A through 3C.

That is, FIG. 2A illustrates a state in which the sheet P is fed by the pickup roller 31 from the first sheet storage portion 28*b* and the sheet bundle Sb within the second sheet storage portion 28*a* is kept in a standby state. Then, FIG. 2B illustrates a state in which the sheet P within the first sheet storage portion 28*b* runs out and the lifter plate 35 is lowered to its lowest position. Then, FIG. 3A illustrates a state in which the sheet bundle Sb is shifted collectively from the second sheet storage portion 28*a* to the first sheet storage portion 28*b*.

FIG. 3B illustrates a state in which the shift of the sheet bundle Sb to the first sheet storage portion 28*b* is completed. Then, FIG. 3C illustrates a state in which the sheet bundle moving member 37 is returned to its home position on the second sheet storage portion 28*a* side and the lifter plate 35 is lifted to deliver an uppermost sheet P on the lifter plate 35 by the pickup roller 31.

Thus, it is possible to continue an image forming process even if the sheet P within the first sheet storage portion 28*b* runs out by repeatedly replenishing the sheet bundle Sb by automatically and continuously performing the steps in FIGS. 2A through 3C. That is, it is possible to continue the image forming operation (printing operation) by swiftly shifting the sheet bundle Sb already set within the second sheet storage portion 28*a* to the first sheet storage portion 28*b*.

As illustrated in FIG. 4C, the sheet bundle moving member 37 is pulled back to the predetermined position by the charged spring force if the user draws the sheet feed cassette 93 out of the apparatus body 201*a* right after when the shift of the sheet bundle Sb is finished. Then, when the sheet feed cassette 93 is drawn out of the apparatus body 201*a*, the driven coupling 48 is decoupled from the drive transmitting coupling 49 supported by the apparatus body 201*a* side. Then, because the driving force from the driving motor 50 to the driving shaft 40*a* of the driving pulley 40 is disconnected, a load is suddenly lightened. Thereby, the sheet bundle moving member 37 is instantly pulled back to the second sheet storage portion 28*a* side in drawing the sheet feed cassette 93 out of the apparatus body 201*a*.

It is noted that the driving unit 10 is composed of the driving mechanism 29 comprising the driving motor 50 as a driving source outputting the driving force, the drive transmitting coupling 49, the driven coupling 48, and the timing belt 41 as the endless belt. The driving unit 10 is linked with the sheet shifting portion through a transmission portion 18 described later to transmit the driving force of the driving unit 10 to the sheet shifting portion and to drive the sheet shifting portion. The present embodiment is configured to be able to move the sheet bundle moving member 37 in an inverse direction toward the second sheet storage portion 28*a* by the forced moving mechanism (the moving portion) 19 when the transmission of the driving force of the driving unit 10 is disconnected.

This arrangement makes it possible to move the sheet bundle moving member 37 automatically to the home position side when the sheet feed cassette 93 is drawn out at the moment when the shift of the sheet bundle by the move of the sheet bundle moving member 37 is finished (when the sheet feed cassette 93 is drawn out at the moment of finishing to shift the sheet bundle). Thus, it is possible to move the sheet bundle moving member 37 automatically to the home position side of the second sheet storage portion 28*a*.

That is, if the sheet feed cassette 93 is drawn out of the attachment space 15 and the link with the driving unit 10 is disconnected in the state in which the sheet bundle moving member 37 has moved to the first sheet storage portion 28*b* side, the forced moving mechanism 19 forcibly moves the sheet bundle moving member 37 to the second sheet storage portion 28*a* side. That is, in the case when the sheet feed cassette 93 is drawn out during when the sheet bundle is being shifted, the sheet bundle moving member 37 can be moved to the second sheet storage portion 28*a* side instantly by the action of the forced moving mechanism 19. Due to that, even if the sheet feed cassette 93 is erroneously drawn out during the shift of the sheet bundle Sb, it is possible to avoid such problem that the sheet bundle Sb is erroneously stacked from occurring because the sheet bundle moving member 37 can be forcibly moved to the second sheet storage portion 28*a* side.

That is, no such problem that the user erroneously sets the sheet bundle Sb on the left side of the sheet bundle moving member 37 (the second sheet storage portion 28*a* side) occurs in a state in which the sheet bundle moving member 37 cannot return to the second sheet storage portion 28*a* side. Due to that, it is possible to avoid the user from erroneously setting the sheet bundle Sb to the sheet feed cassette 93 drawn out of the apparatus body 201*a* on the back side of the sheet bundle moving member 37 stopping after having moved to the first sheet storage portion 28*b* side. Accordingly, it is possible to reliably avoid such situations that the sheet bundle moving member 37 cannot return to the home position and the printer 201 has to be stopped or an alarm is indicated from otherwise occurring by erroneously setting the sheet bundle Sb. Thus, it is possible to steadily prevent such problem requiring the cumbersome work that the printer 201 is not recovered until when the user removes the sheet bundle Sb from occurring.

Still further, according to the present embodiment, the charge member 43, i.e., a pulling member, is linked with the tensile spring 44 so as to pull the tensile spring 44 to the first sheet storage portion 28*b* side through the sheet bundle moving member 37 moving from the second sheet storage portion 28*a* side to the first sheet storage portion 28*b* side. When the load of the driving motor (driving source) 50 to the forced moving mechanism 19 is cut, the sheet bundle moving member 37 receives the forced moving force of the tensile spring 44 through the charge member 43 and is moved to the second sheet storage portion 28*a* side. This arrangement makes it possible to move the sheet bundle moving member 37 reliably to the second sheet storage portion 28*a* when the load to the forced moving mechanism 19 is cut.

Still further, the driving unit 10 can move the sheet bundle moving member 37 from the first sheet storage portion 28*b* to the second sheet storage portion 28*a* side in the state in which the sheet feed cassette 93 is attached to the attachment space 15. Because the sheet feeding apparatus 53 includes the driving unit 10 as described above, it is possible to move the sheet bundle moving member 37 steadily and smoothly between the first and second sheet storage portions 28*b* and 28*a* by such simple mechanical configuration.

Still further, according to the present embodiment, the transmission portion 18 is composed of the drive transmitting coupling 49 supported on the apparatus body 201*a* side, the driven coupling 48 supported on the sheet feed cassette 93 side, and the timing belt 41. The sheet bundle moving member 37 is firmly linked with the timing belt 41 so as to be able to move between the first and second sheet storage portions 28*b* and 28*a* by the rotation of the timing belt 41. The driven coupling 48 can be engaged and coupled with the drive transmitting coupling 49 by attaching the sheet feed cassette 93 to the attachment space 15. Still further, the driven coupling 48 can be decoupled and disconnected from the drive transmitting coupling 49 by drawing the sheet feed cassette 93 out of the attachment space 15.

It is possible to simply and reliably switch the link state and the disconnect state by linking/decoupling the driven coupling 48 on the sheet feed cassette 93 side with/from the drive transmitting coupling 49 on the apparatus body 201*a* side. Still further, in response to the link of the driven coupling 48 with the drive transmitting coupling 49, the driving force of the driving motor 50 is transmitted from the drive transmitting coupling 49 to the driven coupling 48, and the timing belt 41 is rotated. It is possible to steadily transmit the driving force of the driving motor 50 to the sheet bundle moving member 37 by the simple mechanical configuration as described above.

The forced moving mechanism 19 includes the tensile spring, i.e., a spring member, 44 charging the moving force by being dragged by the sheet bundle moving member 37 moving from the second sheet storage portion 28*a* to the first sheet storage portion 28*b*. When the sheet feed cassette 93 is drawn out of the attachment space 15, the sheet bundle moving member 37 is moved to the second sheet storage portion 28*a* side by the tensile spring 44 in the state in which the load of the transmission portion 18 is cut. At this time, it is possible to steadily make the moving force act on the sheet bundle moving member 37 and move the sheet bundle moving member 37 to the second sheet storage portion 28*a* side just by drawing the sheet feed cassette 93 out of the apparatus body 201*a*.

The charge member 43 also pulls the tensile spring 44 to the first sheet storage portion 28*b* side by engaging with the sheet bundle moving member 37 moving from the second sheet storage portion 28*a* side to the first sheet storage portion 28*b* side. Then, when the load of the driving motor 50 on the forced moving mechanism 19 is cut, the sheet bundle moving member 37 receives the moving force of the tensile spring 44 through the charge member 43 and is returned to the second sheet storage portion 28*a* side. Therefore, it is possible to release the load of the driving motor 50 being applied on the forced moving mechanism 19 and to move the sheet bundle moving member 37 to the second sheet storage portion 28*a* side quickly by the moving force of the tensile spring 44 automatically by drawing the sheet feed cassette 93 out of the apparatus body 201*a*.

The forced moving mechanism 19 also charges the moving force forcibly moving the sheet bundle moving member 37 to the second sheet storage portion 28*a* side when the sheet bundle moving member 37 is moved from the second sheet storage portion 28*a* side to the first sheet storage portion 28*b* side by the driving unit 10. This arrangement makes it possible to reliably charge the moving force in the direction of returning the sheet bundle moving member 37 after extending the tensile spring 44 just by moving the sheet bundle moving member 37 to the first sheet storage portion 28*b* side by the driving force of the driving motor 50.

It is noted that while the known tensile spring whose load increases as the spring is dragged more has been exemplified in the present embodiment, another method using a compression type spring in contrary may be adopted as long as the sheet bundle moving member 37 can be moved to the home position side. That is, the spring is not limited to the tensile spring 44 of the present embodiment.

Still further, while the charge member 43 slidably moving within the guide portion 42 illustrated in FIGS. 4A through 4C has been configured so as to start to move from the middle part of the second sheet storage portion 28*a* in the present embodiment, the present invention is not limited to such configuration. That is, the charge member 43 and the tensile spring 44 may be configured such that the charge member 43 and the tensile spring 44 are disposed farther on the left side of the second sheet storage portion 28*a* and the tensile spring 44 can charge the moving force as soon as the sheet bundle moving member 37 starts to move from its home position. Then, the charge member 43 and the tensile spring 44 may be configured such that the sheet bundle moving member 37 moves to the home position detectable by the bundle pressing HP sensor 81 when the charge member 43 returns to the second sheet storage portion 28*a* side by the moving force. In this case, the user can replenish a sheet bundle Sb to the second sheet storage portion 28*a* as it is in a state in which the sheet bundle moving member 37 has returned to the home position.

It is noted that while the sheet bundle moving member 37 has been configured to instantly move in the left direction by the action of the charge member 43 and the tensile spring 44 when the user draws the sheet feed cassette 93 out of the apparatus body 201*a* in the present embodiment, the present invention is not limited to such configuration. For instance, the sheet bundle moving member 37 may be moved by the charge member 43 and the tensile spring 44 also at timing when the user draws the sheet feed cassette 93 out to the draw-out position. The user will notice that the sheet bundle moving member 37 is not located at the home position by watching that the sheet bundle moving member 37 is moving to the home position side. Then, it is also possible to urge the user to move the sheet bundle moving member 37 to the home position. In this case, the sheet bundle moving member 37 may not be returned to the home position by the action of the charge member 43 and the tensile spring 44.

Still further, the case when the sheet feed cassette 93 is drawn out of the apparatus body 201*a* when the sheet bundle moving member 37 is located between the first and second sheet storage portions 28*b* and 28*a* has been described with reference to FIGS. 4B and 4C, the present invention is not limited to such configuration. For instance, the configuration of the present embodiment is effective even in a case when the sheet bundle moving member 37 is located at an area overlapping with the second sheet storage portion 28*a* in FIGS. 4A through 4C if the user can store the sheet P in the left part of the sheet bundle moving member 37.

First Modified Example

Figure 7:
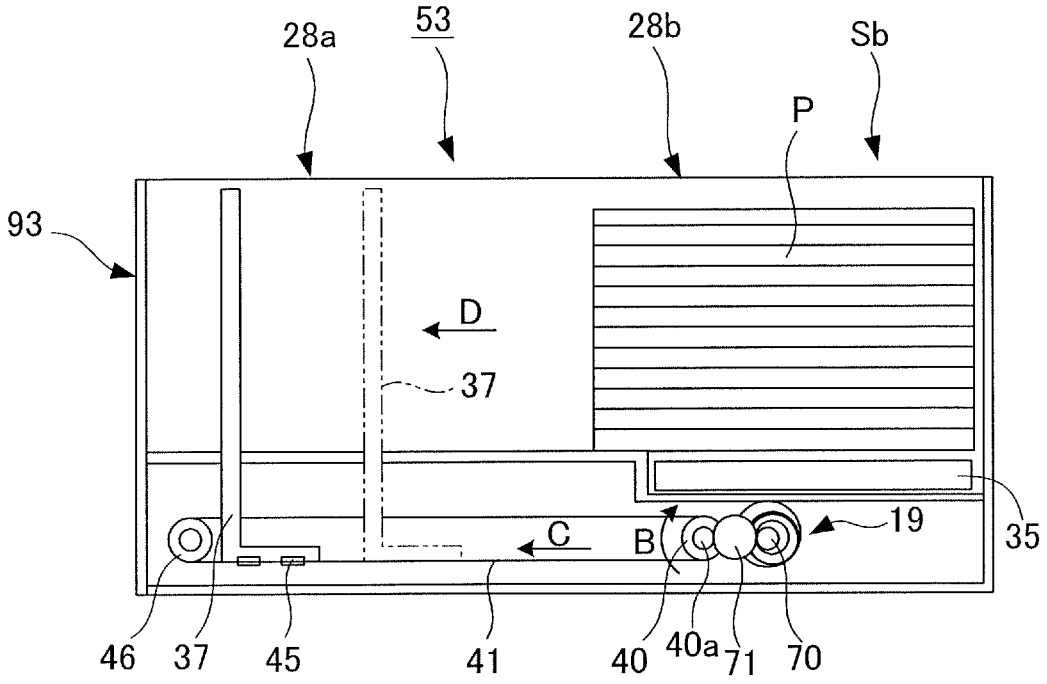
FIG. 7 is a section view schematically illustrating a forced moving mechanism of a sheet feeding apparatus of a first modified example.

Next, a first modified example of the embodiment described above will be described with reference to FIG. 7. FIG. 7 is a section view illustrating the forced moving mechanism 19 and others of the sheet feeding apparatus 53 of the first modified example. It is noted that the same or corresponding members with those of the embodiment described above will be denoted by the same reference numerals and descriptions of those having the same configurations and functions will be omitted.

While a basic part of the first modified example is the same with the configuration of the embodiment described above with reference to FIGS. 4A through 4C, the forced moving mechanism, i.e., the moving portion, 19 is provided with not the tensile spring 44 but a spiral spring member 70. That is, a transmission gear 71 engaging with a gear portion not illustrated provided on the driving pulley 40 is disposed on the first sheet storage portion 28*b* side of the timing belt 41 stretched between the driving pulley 40 and the driven pulley 46 a gear portion around which the spiral spring member 70 is wound is engaged with the transmission gear 71.

The arrangement described above also makes it possible to move the sheet bundle moving member 37 from the second sheet storage portion 28*a* side to the first sheet storage portion 28*b* side by the timing belt 41 rotated by the rotating driving pulley 40 by the first modified example in the same manner with the embodiment described above. At this time, it is possible to charge the moving force by rotating the spiral spring member 70 through the transmission gear 71.

According to the forced moving mechanism 19 of the first modified example constructed as described above, it is possible to charge the moving force by rotating the spiral spring member 70 in linkage with the move of the sheet bundle moving member 37 from the second sheet storage portion 28*a* side to the first sheet storage portion 28*b* side. Then, it is possible to move the sheet bundle moving member 37 to the second sheet storage portion 28*a* side by the spiral spring member 70 in the state in which the load of the transmission portion 18 is cut when the sheet feed cassette 93 is drawn out of the attachment space 15.

According to the first modified example described above, the driven coupling 48 on the sheet feed cassette 93 side is decoupled from the drive transmitting coupling 49 on the apparatus body 201*a* side and the driving force of the driving motor 50 is released when the sheet feed cassette 93 is drawn out of the apparatus body 201*a*. Thereby, the spiral spring member 70 thus set free rotates in an inverse direction, so that the driving pulley 40 is driven in a direction of an arrow B, a lower part of the timing belt 41 rotates in a direction of an arrow C, and the sheet bundle moving member 37 is moved in a direction of an arrow D. This arrangement makes it possible to obtain the same effect with the embodiment described above because the sheet bundle moving member 37 instantly moves toward the home position on the second sheet storage portion 28*a* side.

It is noted that in the first modified example, it is possible to apply a pre-load by the spiral spring member 70 to the sheet bundle moving member 37 at the home position indicated by a solid line in FIG. 7. This arrangement makes it possible to immediately return the sheet bundle moving member 37 to the home position illustrated in FIG. 7 by the moving force of the spiral spring member 70 when the sheet feed cassette 93 is drawn out of the apparatus body 201*a* after moving the sheet bundle moving member 37 to the first sheet storage portion 28*b* side.

In contrary, it is conceivable that the sheet bundle moving member 37 returns only to an intermediate position indicated by a two-dot chain line in FIG. 7 if the pre-load by the spiral spring member 70 is not applied to the sheet bundle moving member 37. However, because the sheet bundle moving member 37 can be moved to the middle part of the second sheet storage portion 28*a* side also in this case, no such problem that the user erroneously sets a sheet bundle Sb on the left side of the sheet bundle moving member 37 in FIG. 7 in a state in which the sheet bundle moving member 37 is unable to return to the second sheet storage portion 28*a* side occurs.

Second Modified Example

Figure 8:
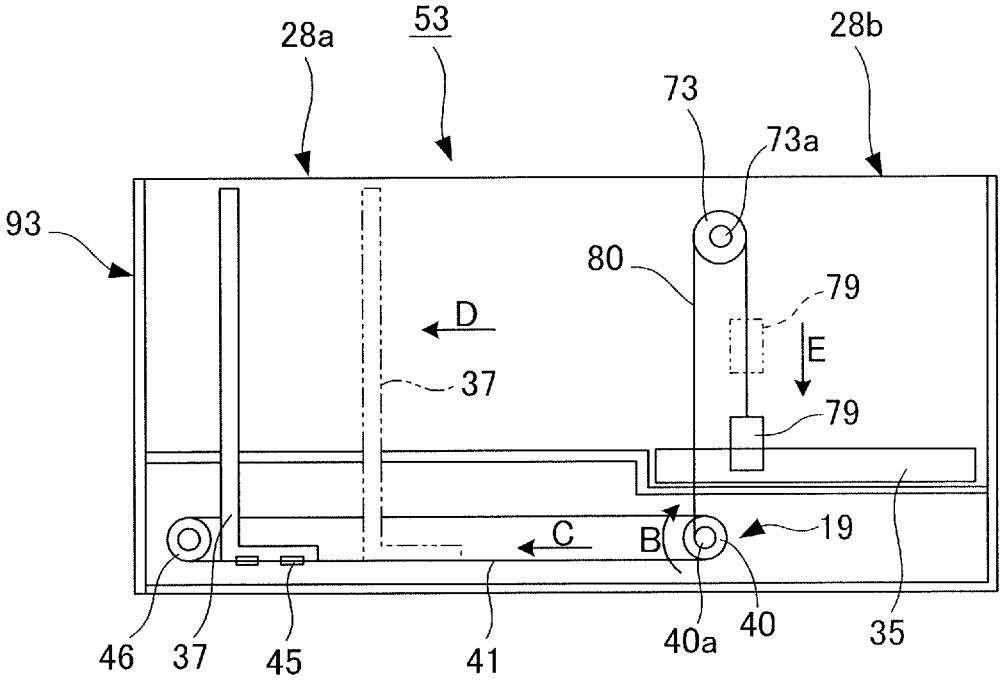
FIG. 8 is a section view schematically illustrating a forced moving mechanism of a sheet feeding apparatus of a second modified example.

Next, a second modified example of the embodiment described above will be described with reference to FIG. 8. FIG. 8 is a section view illustrating the forced moving mechanism 19 and others of the sheet feeding apparatus 53 of the second modified example. It is noted that the same or corresponding members with those of the embodiment described above will be denoted by the same reference numerals and descriptions of those having the same configurations and functions will be omitted.

While a basic part of the second modified example is the same with the configuration of the embodiment described above with reference to FIGS. 4A through 4C, the forced moving mechanism, i.e., the moving portion, 19 is provided with not the tensile spring 44 but a weight 79, i.e., a weight member. That is, one end of a wire 80 is fixed windably round an end side of a driving shaft 40*a* of the driving pulley 40 on the first sheet storage portion 28*b* side of the timing belt 41 stretched between the driving pulley 40 and the driven pulley 46. Then, another end of the wire 80 is attached to the weight (weight member) 79 of a predetermined weight through a pulley 73 rotatably supported to a rotary shaft 73*a*. This arrangement makes it possible to rotate the driving shaft 40*a* in a direction of an arrow B when the weight 79 falls by its own weight in a direction of an arrow E and to move the sheet bundle moving member 37 in a direction of an arrow D in which the sheet bundle moving member 37 returns to its home position.

The arrangement described above also makes it possible to move the sheet bundle moving member 37 from the second sheet storage portion 28*a* side to the first sheet storage portion 28*b* side by the timing belt 41 rotated by the rotating driving pulley 40 by the second modified example in the same manner with the embodiment described above. At this time, it is possible to charge the moving force by lifting the weight 79 while winding the wire 80 around the driving shaft 40*a*.

According to the forced moving mechanism 19 of the second modified example constructed as described above, it is possible to charge the moving force as a potential energy by the weight 79 lifting in linkage with the move of the sheet bundle moving member 37 from the second sheet storage portion 28*a* side to the first sheet storage portion 28*b* side. Then, it is possible to move the sheet bundle moving member 37 to the second sheet storage portion 28*a* side by the moving force of the weight 79 immediately falling in the state in which the load of the transmission portion 18 is reduced when the sheet feed cassette 93 is drawn out of the attachment space 15.

According to the second modified example described above, the driven coupling 48 on the sheet feed cassette 93 side is decoupled from the drive transmitting coupling 49 on the apparatus body 201*a* side and the driving force of the driving motor 50 is released when the sheet feed cassette 93 is drawn out of the apparatus body 201*a*. Thereby, because the weight 79 thus set free falls by its own weight, the driving pulley 40 is rotated in the direction of the arrow B, the lower part of the timing belt 41 rotates in the direction of the arrow C, and the sheet bundle moving member 37 is moved in the direction of the arrow D. This arrangement makes it possible to obtain the same effect with the embodiment described above because the sheet bundle moving member 37 instantly moves toward the home position on the second sheet storage portion 28*a* side.

It is noted that the configuration in which the sheet bundle moving member 37 is forcibly moved to the second sheet storage portion 28*a* side in response to the decoupling of the driven coupling 48 from the drive transmitting coupling 49 has been described in the embodiment and in the first and second modified examples. However, the present invention is not limited to such configuration and may be configured as follows. For instance, it is possible to configure such that the driving unit such as the motor and the gear train not illustrated driving the charge member 43 is provided on the sheet feed cassette 93 side and power is supplied to the motor from the apparatus body 201*a* side through a connector or the like not illustrated. Then, it is possible to configure such that the sheet bundle moving member 37 moves toward the second sheet storage portion 28*a* when the supply (transmission) of the power through the connector is disconnected. It is noted that in this case, it is preferable to use a normal DC motor not generating cogging torque and others as the motor setting on the sheet feed cassette 93 side. Such arrangement also makes it possible to bring about effects substantially the same with those of the embodiment and the first and second modified examples described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-043472, filed Mar. 5, 2015 and Japanese Patent Application No. 2015-241946, filed Dec. 11, 2015 which are hereby incorporated by reference herein in its entirety.

What is claimed is:

1. A sheet feeding apparatus comprising:

an apparatus body;

a feed member feeding a sheet;

a sheet storage member configured to be movable to an attachment position where the sheet storage member is attached to the apparatus body and to a draw-out position where the sheet storage member is drawn out of the attachment position, and comprising a first sheet storage portion in which a plurality of sheets to be fed by the feed member are stored and a second sheet storage portion in which a plurality of sheets are stored, the second sheet storage portion being provided upstream of the first sheet storage portion in a first direction that is in a horizontal plane, the sheets stored in the second sheet storage portion to be fed into the first sheet storage portion in a state in which the first sheet storage portion becomes empty of sheets;

a sheet detector configured to detect whether or not a sheet exists in the first sheet storage portion;

a sheet shifting portion configured to push upstream ends of the sheets in the second sheet storage portion in the first direction so as to shift the sheets as a sheet bundle in the second sheet storage portion to the first sheet storage portion in the first direction in a case where the sheet detector detects that the first sheet storage portion becomes empty of sheets, the sheet shifting portion being configured to position at a first position and a second position farther than the first position from the first sheet storage portion;

a driving motor configured to generate a driving force moving the sheet shifting portion in a state in which the sheet storage member is located at the attachment position; and a moving portion configured to move the sheet shifting portion from the first position to the second position in a state in which the sheet shifting portion does not receive the driving force from the driving motor.

2. The sheet feeding apparatus according to claim 1, wherein the moving portion stores the driving force from the driving motor for moving the sheet shifting portion from the first position to the second position upon the sheet shifting portion being moved from the second sheet storage portion to the first sheet storage portion by the driving motor.

3. The sheet feeding apparatus according to claim 1, wherein the moving portion includes a spring member deformed by the driving force from the driving motor, and wherein the sheet shifting portion is moved to the second position by a restoring force of the deformed spring member in response to a drawing operation of the sheet storage member from the apparatus body.

4. The sheet feeding apparatus according to claim 3, wherein the moving portion includes a pulling member linked with the spring member such that the spring member is pulled to a first sheet storage portion side through the sheet shifting portion moving from the second position to the first position, and wherein the sheet shifting portion receives the restoring force of the deformed spring member through the pulling member and is moved to the second position in response to the drawing operation of the sheet storage member from the apparatus body.

5. The sheet feeding apparatus according to claim 1, wherein the moving portion includes a spiral spring member deformed by rotating in linkage with the move of the sheet shifting portion from the second position to the first position, and wherein the sheet shifting portion is moved to the second position by a restoring force of the deformed spiral spring member in response to a drawing operation of the sheet storage member from the apparatus body.

6. The sheet feeding apparatus according to claim 1, wherein the moving portion includes a weight member charging a potential energy by elevating in linkage with the move of the sheet shifting portion from the second position to the first position, and wherein the sheet shifting portion is moved to the second position by the potential energy of the weight member in response to a drawing operation of the sheet storage member from the apparatus body.

7. The sheet feeding apparatus according to claim 1, further comprising a transmission portion transmitting the driving force from the driving motor to the sheet shifting portion.

8. The sheet feeding apparatus according to claim 7, wherein the transmission portion comprises a drive transmitting coupling being supported by the apparatus body and receiving the driving force from the driving motor, and a driven coupling being supported by the sheet storage member, engaging with the drive transmitting coupling in a state in which the sheet storage member is attached to the apparatus body, and decoupling from the drive transmitting coupling in response to a drawing operation of the sheet storage member from the apparatus body, and wherein the moving portion moves the sheet shifting portion from the first position to the second position in a state in which the driven coupling is decoupling from the drive transmitting coupling in response to the drawing operation of the sheet storage member from the apparatus body.

9. The sheet feeding apparatus according to claim 8, wherein the transmission portion comprises an endless belt rotated by the driving force of the driving motor transmitted from the drive transmitting coupling to the driven coupling, the endless belt being linked with the sheet shifting portion such that the sheet shifting portion moves by the rotation of the endless belt.

10. The sheet feeding apparatus according to claim 1, wherein the first position is located between the first sheet storage portion and the second sheet storage portion.

11. The sheet feeding apparatus according to claim 1, wherein the second position is located inside of the second sheet storage portion.

12. The sheet feeding apparatus according to claim 1, wherein the second position is located outside of the second sheet storage portion on a side farther than the first sheet storage portion in a moving direction of the sheet shifting portion.

13. The sheet feeding apparatus according to claim 1, wherein the moving portion moves the sheet shifting portion from the first position to the second position in a state in which linkage of the sheet shifting portion with the driving motor is disconnected in response to a drawing operation of the sheet storage member from the apparatus body.

14. A sheet feeding apparatus comprising:

an apparatus body;

a feed member feeding a sheet;

a sheet storage member configured to be movable to an attachment position where the sheet storage member is attached to the apparatus body and to a draw-out position where the sheet storage member is drawn out of the attachment position and comprising a first sheet storage portion in which the sheet to be fed by the feed member is stored and a second sheet storage portion in which a sheet is stored, the second sheet storage portion being provided upstream of the first sheet storage portion in a first direction that is in a horizontal plane;

a sheet shifting portion configured to push an upstream end of the sheet in the second sheet storage portion in the first direction so as to shift the sheet in the second sheet storage portion to the first sheet storage portion in the first direction;

a driving motor configured to generate a driving force moving the sheet shifting portion at least in the first direction, the sheet shifting portion receiving the driving force from the driving motor so as to shift the sheet in the second sheet storage portion to the first sheet storage portion in a state in which the sheet shifting portion is drivingly connected with the driving motor and in which the sheet storage member is in the attachment position, wherein the sheet shifting portion is disconnected from the driving motor in response to a drawing operation of the sheet storage member; and a moving portion configured to move the sheet shifting portion in a second direction opposite to the first direction in a state in which the sheet shifting portion is disconnected from the driving motor and in which the sheet shifting portion does not receive the driving force from the driving motor.

15. The sheet feeding apparatus according to claim 14, wherein the moving portion stores the driving force from the driving motor.

16. The sheet feeding apparatus according to claim 14, wherein the moving portion includes a spring member deformed by the driving force from the driving motor.

17. The sheet feeding apparatus according to claim 16, wherein the moving portion includes a pulling member linked with the spring member such that the spring member is pulled to a first sheet storage portion side through the sheet shifting portion moving in the first direction, and wherein the sheet shifting portion receives a restoring force of the deformed spring member through the pulling member.

18. The sheet feeding apparatus according to claim 14, wherein the moving portion includes a spiral spring member deformed by rotating in linkage with the move of the sheet shifting portion in the first direction.

19. The sheet feeding apparatus according to claim 14, wherein the moving portion includes a weight member charging a potential energy by elevating in linkage with moving of the sheet shifting portion in the first direction.

20. The sheet feeding apparatus according to claim 14, further comprising a transmission portion transmitting the driving force from the driving motor to the sheet shifting portion.

21. The sheet feeding apparatus according to claim 20, wherein the transmission portion comprises a drive transmitting coupling being supported by the apparatus body and receiving the driving force from the driving motor, and a driven coupling being supported by the sheet storage member, engaging with the drive transmitting coupling in a state in which the sheet storage member is attached to the apparatus body, and decoupling from the drive transmitting coupling in response to the drawing operation of the sheet storage member from the apparatus body, and wherein the moving portion moves the sheet shifting portion in the second direction in a state in which the driven coupling is decoupling from the drive transmitting coupling in response to the drawing operation of the sheet storage member from the apparatus body.

22. The sheet feeding apparatus according to claim 21, wherein the transmission portion comprises an endless belt rotated by the driving force of the driving motor transmitted from the drive transmitting coupling to the driven coupling, the endless belt being linked with the sheet shifting portion such that the sheet shifting portion moves by the rotation of the endless belt.

23. The sheet feeding apparatus according to claim 14, wherein the sheet shifting portion is moved to a first position by the driving force from the driving motor, and wherein the first position is located between the first sheet storage portion and the second sheet storage portion.

24. The sheet feeding apparatus according to claim 14, wherein the sheet shifting portion is moved to a second position by the moving portion, and wherein the second position is located inside of the second sheet storage portion.

25. The sheet feeding apparatus according to claim 14, wherein the sheet shifting portion is moved to a second position by the moving portion, and wherein the second position is located outside of the second sheet storage portion on a side farther than the first sheet storage portion.

26. A sheet feeding apparatus comprising:

an apparatus body;

a feed member feeding a sheet;

a sheet storage member configured to be movable to an attachment position where the sheet storage member is attached to the apparatus body and to a draw-out position where the sheet storage member is drawn out of the attachment position and comprising a first sheet storage portion in which a plurality of sheets to be fed by the feed member are stored and a second sheet storage portion in which a plurality of sheets are stored, the second sheet storage portion being provided upstream of the first sheet storage portion in a first direction that is in a horizontal plane, the sheets stored in the second sheet storage portion to be fed into the first sheet storage portion in a state in which the first sheet storage portion becomes empty of sheets;

a sheet detector configured to detect whether or not a sheet exists in the first sheet storage portion;

a sheet bundle moving member configured to push upstream ends of the sheets in the second sheet storage portion in the first direction so as to shift the sheets as a sheet bundle in the second sheet storage portion to the first sheet storage portion in the first direction in a case where the sheet detector detects that the first sheet storage portion becomes empty of sheets;

a driving motor configured to generate a driving force moving the sheet bundle moving member such that the sheets in the second sheet storage portion are shifted to the first sheet storage portion; and a spring member configured to move the sheet bundle moving member from a first position to a second position farther than the first position with respect to the first sheet storage portion in a case which the sheet storage member is located at the draw-out position.

27. An image forming apparatus comprising:

a sheet feeding apparatus feeding a sheet, the sheet feeding apparatus including:

an apparatus body;

a feed member feeding the sheet;

a sheet storage member configured to be movable to an attachment position where the sheet storage member is attached to the apparatus body and to a draw-out position where the sheet storage member is drawn out of the attachment position, and comprising a first sheet storage portion in which a plurality of sheets to be fed by the feed member are stored and a second sheet storage portion in which a plurality of sheets are stored, the second sheet storage portion being provided upstream of the first sheet storage portion in a first direction that is in a horizontal plane, the sheets stored in the second sheet storage portion to be fed into the first sheet storage portion in a state in which the first sheet storage portion becomes empty of sheets;

a sheet detector configured to detect whether or not a sheet exists in the first sheet storage portion;

a sheet shifting portion configured to push upstream ends of the sheets in the second sheet storage portion in the first direction so as to shift the sheets as a sheet bundle in the second sheet storage portion to the first sheet storage portion in the first direction in a case where the sheet detector detects that the first sheet storage portion becomes empty of sheets, the sheet shifting portion being configured to position at a first position and a second position farther than the first position from the first sheet storage portion;

a driving motor configured to generate a driving force moving the sheet shifting portion in a state in which the sheet storage member is located at the attachment position; and a moving portion configured to move the sheet shifting portion from the first position to the second position in a state in which the sheet shifting portion does not receive the driving force from the driving motor; and an image forming unit forming an image on the sheet fed by the sheet feeding apparatus.

28. An image forming apparatus comprising:

a sheet feeding apparatus feeding a sheet, the sheet feeding apparatus including:

an apparatus body;

a feed member feeding the sheet;

a sheet storage member configured to be movable to an attachment position where the sheet storage member is attached to the apparatus body and to a draw-out position where the sheet storage member is drawn out of the attachment position and comprising a first sheet storage portion in which the sheet to be fed by the feed member is stored and a second sheet storage portion in which a sheet is stored, the second sheet storage portion being provided upstream of the first sheet storage portion in a first direction that is in a horizontal plane;

a sheet shifting portion configured to push an upstream end of the sheet in the second sheet storage portion in the first direction so as to shift the sheet in the second sheet storage portion to the first sheet storage portion in the first direction;

a driving motor configured to generate a driving force moving the sheet shifting portion at least in the first direction, the sheet shifting portion receiving the driving force from the driving motor so as to shift the sheet in the second sheet storage portion to the first sheet storage portion in a state in which the sheet shifting portion is drivingly connected with the driving motor and in which the sheet storage member is in the attachment position, wherein the sheet shifting portion is disconnected from the driving motor in response to a drawing operation of the sheet storage member; and a moving portion configured to move the sheet shifting portion in a second direction opposite to the first direction in a state in which the sheet shifting portion is disconnected from the driving motor and in which the sheet shifting portion does not receive the driving force from the driving motor; and an image forming unit forming an image on the sheet fed by the sheet feeding apparatus.

29. An image forming apparatus comprising:

a sheet feeding apparatus feeding a sheet, the sheet feeding apparatus including:

an apparatus body;

a feed member feeding the sheet;

a sheet storage member configured to be movable to an attachment position where the sheet storage member is attached to the apparatus body and to a draw-out position where the sheet storage member is drawn out of the attachment position, and comprising a first sheet storage portion in which a plurality of sheets to be fed by the feed member are stored and a second sheet storage portion in which a plurality of sheets are stored, the second sheet storage portion being provided upstream of the first sheet storage portion in a first direction that is in a horizontal plane, the sheets stored in the second sheet storage portion to be fed into the first sheet storage portion in a state in which the first sheet storage portion becomes empty of sheets;

a sheet detector configured to detect whether or not a sheet exists in the first sheet storage portion;

a sheet bundle moving member configured to push upstream ends of the sheets in the second sheet storage portion in the first direction so as to shift the sheets as a sheet bundle in the second sheet storage portion to the first sheet storage portion in the first direction in a case where the sheet detector detects that the first sheet storage portion becomes empty of sheets;

a driving motor configured to generate a driving force moving the sheet bundle moving member such that the sheets in the second sheet storage portion are shifted to the first sheet storage portion; and a spring member configured to move the sheet bundle moving member from a first position to a second position farther than the first position with respect to the first sheet storage portion in a case which the sheet storage member is located at the draw-out position; and an image forming unit forming an image on the sheet fed by the sheet feeding apparatus.

* * * * *